US007877945B2

(12) United States Patent
Eggen et al.

(10) Patent No.: US 7,877,945 B2
(45) Date of Patent: Feb. 1, 2011

(54) FLASHING ASSEMBLY WITH CROSS CHANNELS AND METHOD FOR SAME

(75) Inventors: Mark D. Eggen, Salol, MN (US); Tim Stoll, Warroad, MN (US); Daniel G. Carpenter, Warroad, MN (US)

(73) Assignee: Marvin Lumber and Cedar Company, Warroad, MN (US)

( * ) Notice: Subject to any disclaimer, the term of this patent is extended or adjusted under 35 U.S.C. 154(b) by 1408 days.

(21) Appl. No.: 11/342,307

(22) Filed: Jan. 26, 2006

(65) Prior Publication Data

US 2006/0230593 A1 Oct. 19, 2006

Related U.S. Application Data

(60) Provisional application No. 60/647,195, filed on Jan. 26, 2005.

(51) Int. Cl.
*E04B 1/70* (2006.01)

(52) U.S. Cl. ..... 52/302.3; 52/302.6; 52/95; 52/60; 52/209

(58) Field of Classification Search ..... 52/58, 52/60, 95, 96, 97, 202, 209, 302.3, 302.6
See application file for complete search history.

(56) References Cited

U.S. PATENT DOCUMENTS

| | | | | |
|---|---|---|---|---|
| 1,677,130 | A | | 7/1928 | Cherry |
| 2,154,734 | A | | 4/1939 | Doing |
| 2,245,965 | A | | 6/1941 | Hyman |
| 2,648,107 | A | | 8/1953 | Bates, Jr. |
| 2,697,932 | A | | 12/1954 | Goodwin |
| 3,239,977 | A | | 3/1966 | Shore |
| 3,638,372 | A | * | 2/1972 | Rosenthal ..... 52/97 |
| 4,492,062 | A | | 1/1985 | Levenez |
| 4,555,882 | A | | 12/1985 | Moffitt et al. |
| 4,745,716 | A | | 5/1988 | Kuypers |
| 4,966,819 | A | | 10/1990 | Schatz et al. |
| 5,072,552 | A | | 12/1991 | Sauder |
| 5,179,804 | A | | 1/1993 | Young |
| 5,377,464 | A | | 1/1995 | Mott et al. |
| 5,581,959 | A | | 12/1996 | Occhipinti |

(Continued)

OTHER PUBLICATIONS

U.S. Appl. No. 10/856,380, Final Office Action mailed May 12, 2008, 8 pgs.

(Continued)

*Primary Examiner*—Richard E. Chilcot, Jr.
*Assistant Examiner*—Jessica Laux
(74) *Attorney, Agent, or Firm*—Schwegman, Lundberg & Woessner, P.A.

(57) ABSTRACT

A flashing assembly includes a member extending between a first end and a second end. The flashing member includes a top portion and a flange at an angle to the top portion. The top portion extends from a rear edge to the flange. The top portion includes a mounting surface substantially level from the top portion rear edge toward the flange. The top portion includes at least one channel and at least one cross channel in communication with the channel. In one option, the cross channel is separated from the coupling portion. The channels facilitate trimming of members to desired sizes such that the assembly is used with windows and doors of various sizes.

29 Claims, 29 Drawing Sheets

U.S. PATENT DOCUMENTS

| | | | | |
|---|---|---|---|---|
| 5,822,933 | A | 10/1998 | Burroughs et al. | |
| 5,921,038 | A | 7/1999 | Burroughs et al. | |
| 6,038,821 | A | 3/2000 | Larson et al. | |
| 6,070,370 | A | 6/2000 | Locke | |
| 6,098,343 | A | 8/2000 | Brown et al. | |
| 6,276,099 | B1 | 8/2001 | O'Shea | |
| 6,293,064 | B1 | 9/2001 | Larson | |
| 6,298,614 | B1 | 10/2001 | Fisher | |
| 6,305,130 | B1 | 10/2001 | Ackerman, Jr. | |
| 6,371,188 | B1 | 4/2002 | Baczuk et al. | |
| 6,385,925 | B1 | 5/2002 | Wark | |
| 6,401,401 | B1 | 6/2002 | Williams | |
| 6,401,402 | B1 | 6/2002 | Williams | |
| 6,470,638 | B1 | 10/2002 | Larson | |
| 6,526,709 | B1 | 3/2003 | Jacobsen | |
| 6,725,610 | B2 | 4/2004 | Murphy et al. | |
| 6,789,359 | B2 | 9/2004 | Bauman et al. | |
| 7,059,087 | B2 | 6/2006 | Allen | |
| 7,367,164 | B2 * | 5/2008 | Burton et al. | 52/209 |
| 7,591,106 | B2 * | 9/2009 | Conlin | 52/58 |
| 2001/0034986 | A1 | 11/2001 | Thomas et al. | |
| 2002/0108326 | A1 | 8/2002 | Ackerman, Jr. | |
| 2002/0129557 | A1 | 9/2002 | Young | |
| 2003/0106269 | A1 | 6/2003 | Bauman et al. | |
| 2003/0177711 | A1 | 9/2003 | Gatherum | |
| 2003/0177712 | A1 | 9/2003 | Gatherum | |
| 2003/0177725 | A1 | 9/2003 | Gatherum | |
| 2003/0177727 | A1 | 9/2003 | Gatherum | |
| 2003/0177736 | A1 | 9/2003 | Gatherum | |
| 2004/0200160 | A1 | 10/2004 | Derderian | |
| 2004/0216414 | A1 | 11/2004 | Dickinson | |
| 2005/0011140 | A1 | 1/2005 | Ackerman et al. | |
| 2005/0034385 | A1 | 2/2005 | Broad et al. | |
| 2005/0055912 | A1 | 3/2005 | Teodorovich | |
| 2005/0097837 | A1 * | 5/2005 | Burton | 52/204.1 |
| 2005/0144856 | A1 * | 7/2005 | Conlin | 52/58 |
| 2005/0144865 | A1 | 7/2005 | Ellingson | |
| 2005/0166470 | A1 | 8/2005 | Allen | |
| 2005/0166471 | A1 * | 8/2005 | Allen | 52/58 |
| 2005/0183345 | A1 | 8/2005 | Allen | |
| 2005/0210768 | A1 * | 9/2005 | Lawson et al. | 52/97 |
| 2005/0217189 | A1 | 10/2005 | Moffitt | |
| 2005/0252131 | A1 | 11/2005 | Bushberger | |
| 2005/0262771 | A1 | 12/2005 | Gorman | |
| 2005/0268569 | A1 | 12/2005 | Teodorovich | |
| 2006/0010788 | A1 | 1/2006 | Nettleton | |
| 2006/0143994 | A1 * | 7/2006 | Allen | 52/58 |
| 2006/0156639 | A1 | 7/2006 | Allen | |
| 2006/0168902 | A1 | 8/2006 | Allen | |

OTHER PUBLICATIONS

U.S. Appl. No. 10/856,380, Non-Final Office Action mailed Oct. 2, 2008, 9 Pgs.

U.S. Appl. No. 10/856,380, Non-Final Office Action Mailed Nov. 9, 2007, 12 pgs.

U.S. Appl. No. 10/856,380, Preliminary Amendment filed Nov. 9, 2006, 7 pgs.

U.S. Appl. No. 10/856,380, Preliminary Amendment mailed Mar, 3, 2006, 7 pgs.

U.S. Appl. No. 10/856,380, Response filed Feb. 11, 2008 to Non-Final Office Action mailed Nov. 9, 2007, 16 pgs.

International Application Serial No. PCT/US2004/042323, International Search Report mailed, 3 pgs.

* cited by examiner

FLASHING ASSEMBLY WITH CROSS CHANNELS AND METHOD FOR SAME

RELATED APPLICATION

This application claims the benefit 35 U.S.C. 119(e) of U.S. Provisional Patent Application No. 60/647,195, filed Jan. 26, 2005, which application is incorporated herein by reference and made a part hereof.

TECHNICAL FIELD

Flashing for windows and doors.

TECHNICAL BACKGROUND

Moisture or water in various forms can penetrate around windows, doors and the like, and eventually travel beneath the window or door to accumulate in the interior wall or supporting framing for the window or door. Conventional window and door systems have used caulking, adhesives and/or flashing to prevent entry of water around the windows or doors. These prior methods have not been completely successful. Sealants are difficult to properly install, and further tend to separate from the wall component or wall due to climatic conditions, building movement, the surface type, or chemical reactions.

Flashing may also be difficult to install. In other examples, flashing does not provide a consistent drain path that facilitates transport of moisture away from the window or door and the surrounding framed opening. For instance, with some types of flashing debris (e.g., dirt, insects and the like) collects within portions of the flashing preventing adequate flow of moisture away from the window or door. In another example, the flashing cannot effectively handle the volume of water present around the window or door (e.g., during a storm). In still other examples, flashing systems include a plurality of pieces. Moisture may collect within the joints between pieces because of insufficient routing of the moisture away from the joints. The moisture may then penetrate into the interior wall around the window or door. In yet another example, moisture collects underneath the flashing (e.g., because of condensation) adjacent to the supporting framing and the flashing provides no means for the moisture to escape.

Accordingly, what is needed is a flashing system that effectively drains water away from a window or door assembly.

SUMMARY

A flashing assembly is provided that allows for drainage from around windows and/or doors. The flashing assembly is one part of a moisture management system, where the flashing assembly can be used in conjunction with house wrap/building paper. The flashing assembly collects incidental moisture, and effectively directs the moisture to a drainage plane, for instance between outer wrap of a structure (i.e. TYVEK, a registered trademark of E.I. du Pont de Nemours and Company) and outer siding. Moisture may penetrate to near the window, for example, because of window failure, installation failure, and/or condensation. The flashing assembly can also accommodate multiple window sizes. For example, the flashing assembly accommodates a door. Furthermore, in another example, the flashing assembly accommodates much smaller window sizes.

These and other embodiments, aspects, advantages, and features of the present invention will be set forth in part in the description which follows, and in part will become apparent to those skilled in the art by reference to the following description of the invention and referenced drawings or by practice of the invention. The aspects, advantages, and features of the invention are realized and attained by means of the instrumentalities, procedures, and combinations particularly pointed out in the appended claims and their equivalents.

BRIEF DESCRIPTION OF THE DRAWINGS

In the drawings, which are not necessarily drawn to scale, like numerals describe substantially similar components throughout the several views. Like numerals having different letter suffixes represent different instances of substantially similar components. The drawings illustrate generally, by way of example, but not by way of limitation, various embodiments discussed in the present document.

DESCRIPTION OF THE EMBODIMENTS

In the following detailed description, reference is made to the accompanying drawings which form a part hereof, and in which is shown by way of illustration specific embodiments in which the invention may be practiced. These embodiments are described in sufficient detail to enable those skilled in the art to practice the invention, and it is to be understood that other embodiments may be utilized and that structural changes may be made without departing from the scope of the present invention. Therefore, the following detailed description is not to be taken in a limiting sense, and the scope is defined by the appended claims and their equivalents.

A flashing assembly is provided that allows for drainage from around windows and/or doors. The flashing assembly is one part of a moisture management system, where the flashing assembly can be used in conjunction with house wrap/building paper. The flashing assembly collects incidental moisture, and effectively directs the moisture to a drainage plane, for instance between outer wrap of a structure (i.e. TYVEK®) and outer siding. The moisture sources can occur from, for example, window failure, installation failure, and/or condensation. The flashing assembly can also accommodate multiple window sizes. For example, the flashing assembly can accommodate a 6'0" door. Furthermore, the flashing assembly can also accommodate much smaller window sizes.

Figure 1A:
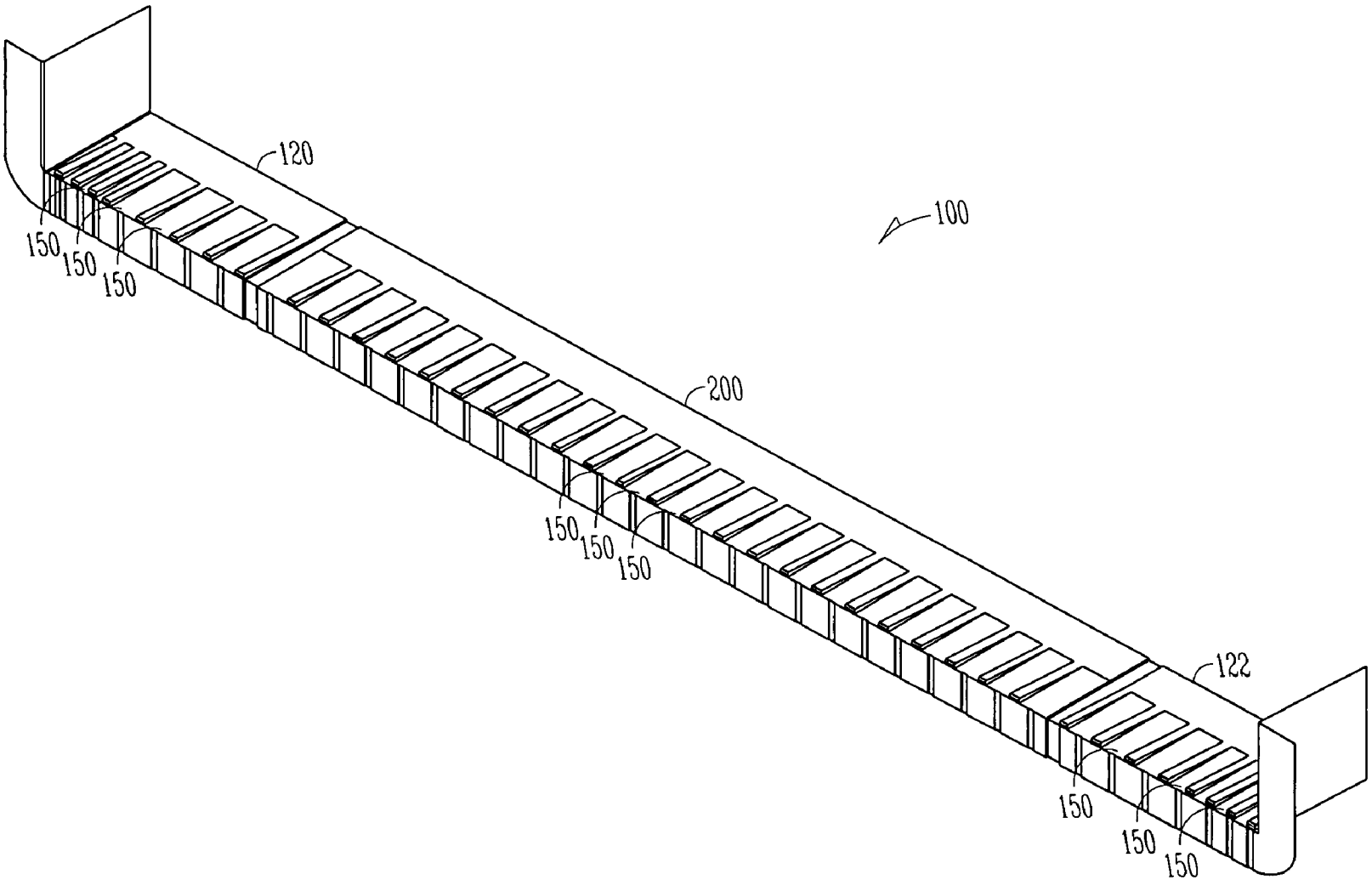
FIG. 1A illustrates a perspective view of a flashing assembly constructed in accordance with at least one example.
Figure 1B:
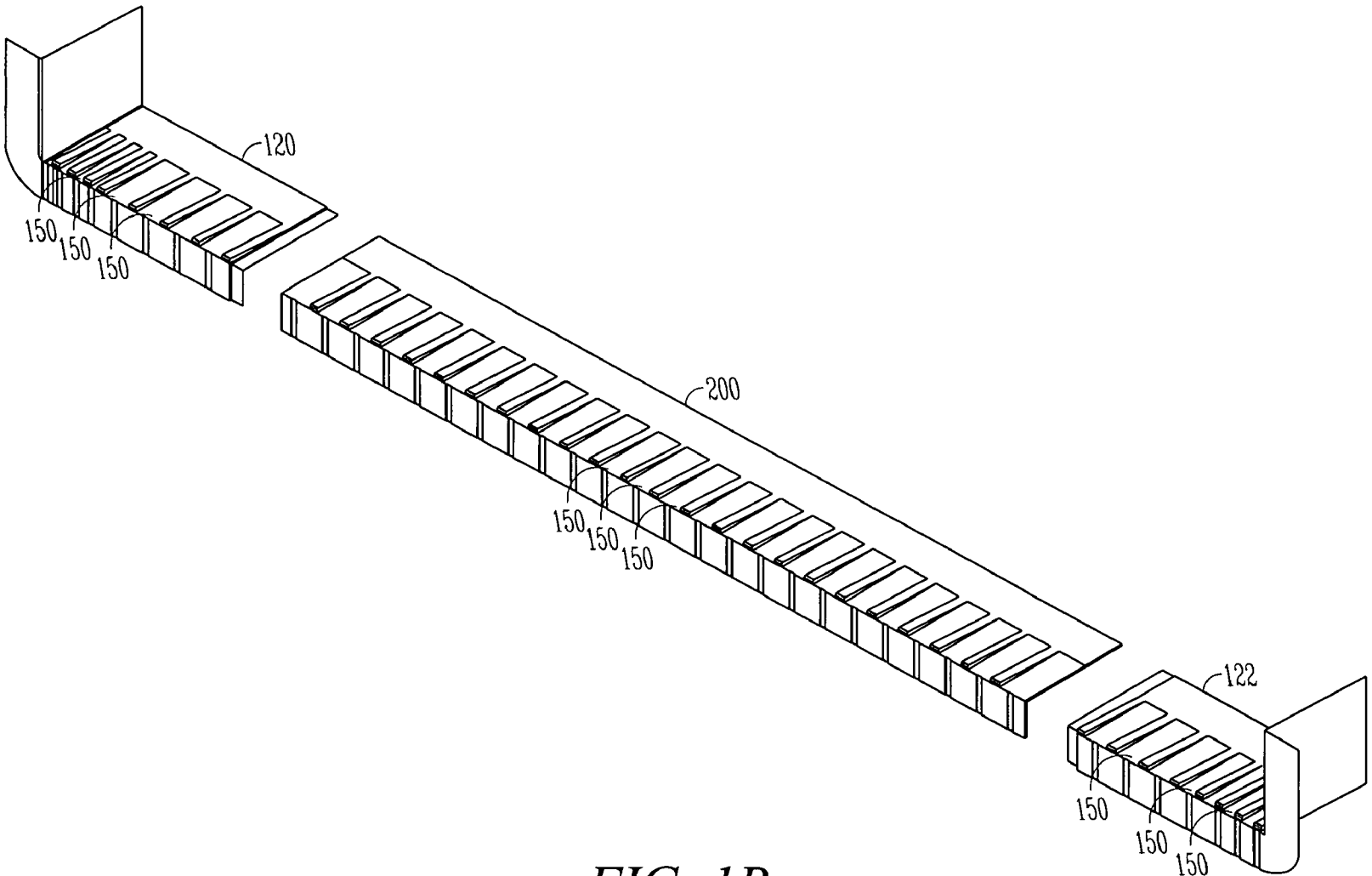
FIG. 1B illustrates an exploded perspective view of a flashing assembly constructed in accordance with at least one example.
Figure 3:
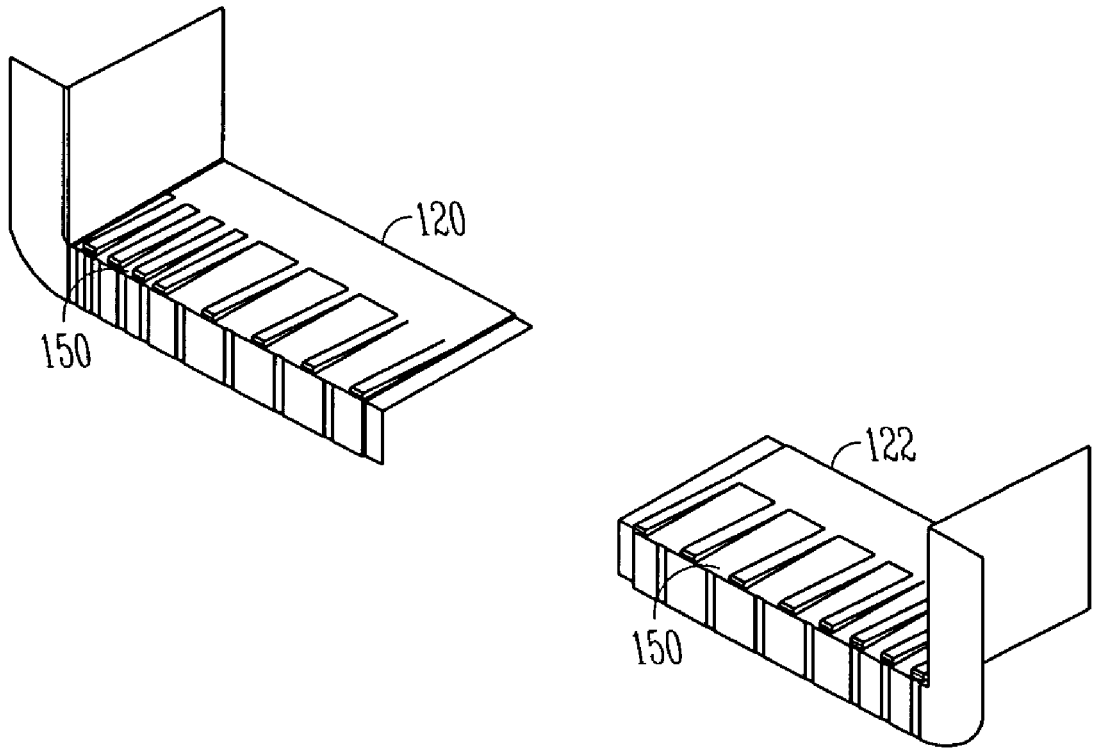
FIG. 3 illustrates a perspective view of a flashing assembly as constructed in accordance with at least one example.

FIGS. 1A, B illustrate one example of a flashing assembly 100. The flashing assembly 100 includes flashing members, such as a first side member 120, a second side member 122, and optionally at least one interconnecting member 200. The interconnecting member 200 is disposed between the first side member 120 and the second side member 122 as further described below. The members 120, 122, 200 each include one or more channels 150 that allow for water to be directed outside of the window system and into the drainage plane. In one option, the members 120, 122, 200 are formed with, but not limited to, molding, injection molding, machining and the like. In another example, the interconnecting member 200 is optional. For instance, as illustrated in FIG. 3, the first side member 120 and the second side member 122 can be used without the interconnecting member 200 to form the flashing assembly 100.

Figure 2A:
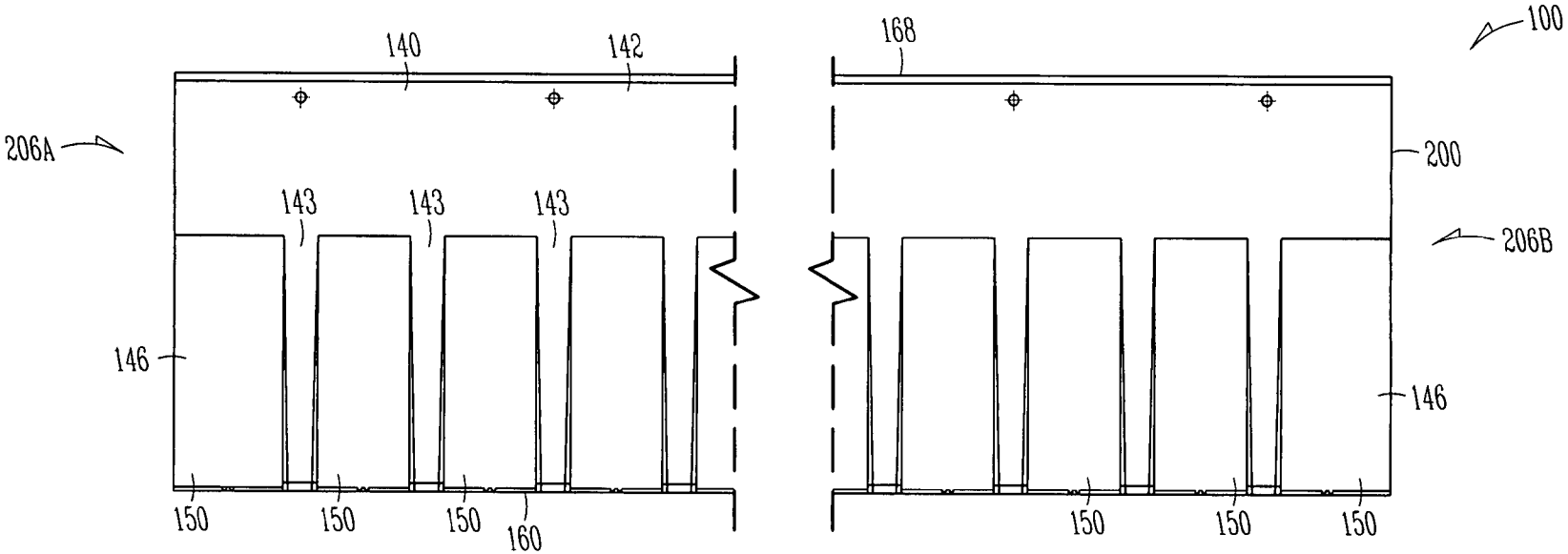
FIG. 2A illustrates a top plan view of a portion of an interconnecting member constructed in accordance with at least one example.
Figure 2B:
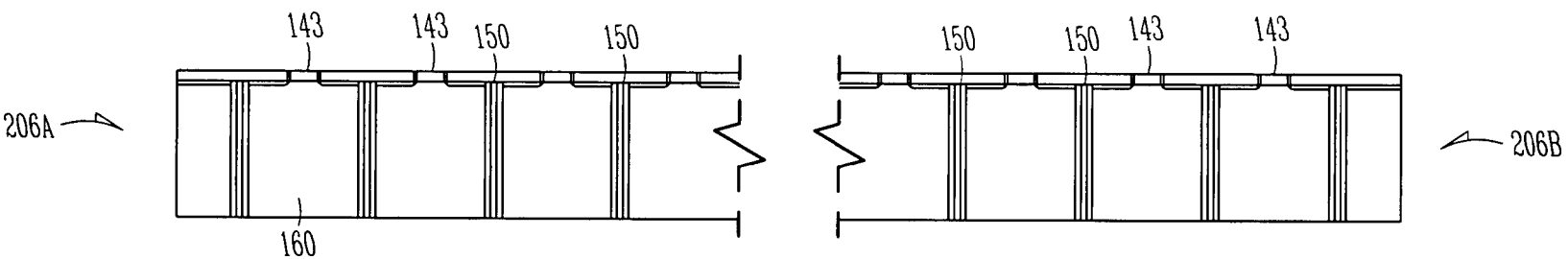
FIG. 2B illustrates a front view of the interconnecting member constructed in accordance with at least one example.
Figure 2C:
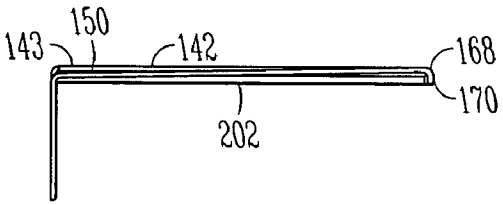
FIG. 2C illustrates a side elevational view of the interconnecting member constructed in accordance with at least one example.
Figure 2D:
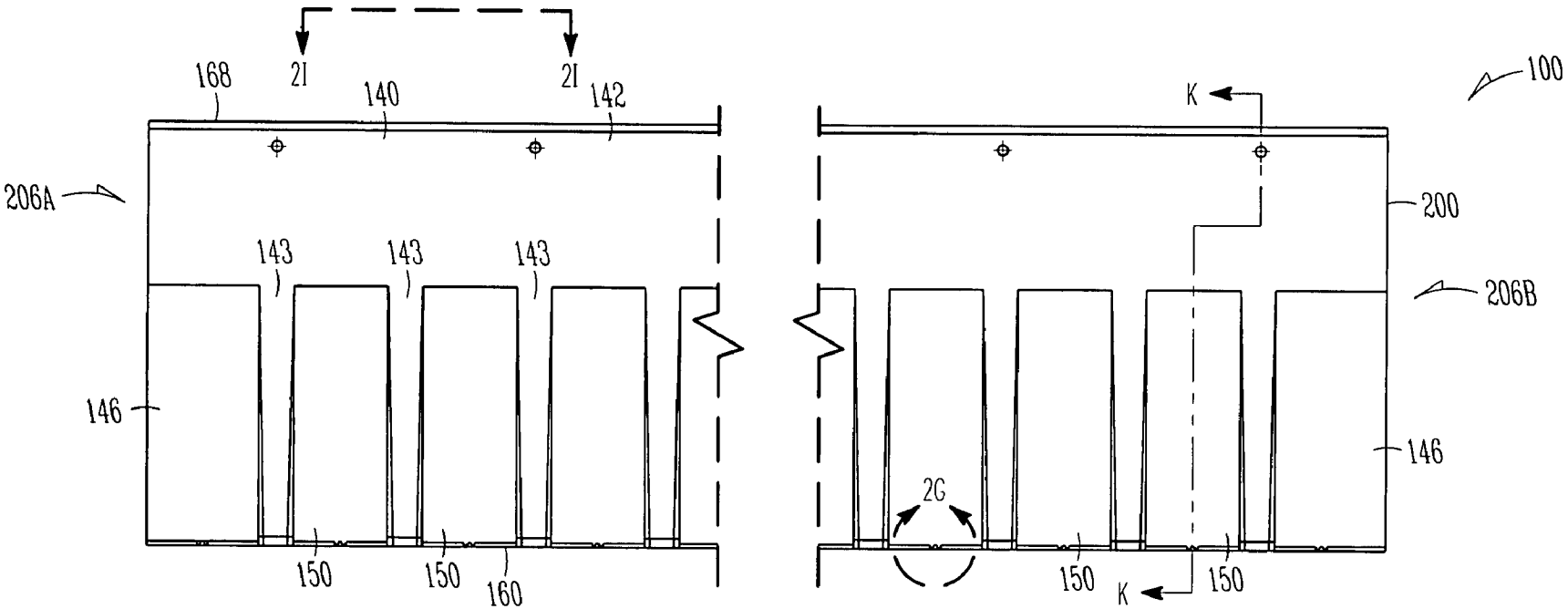
FIG. 2D illustrates a top plan view of a portion of the interconnecting member constructed in accordance with at least one example.
Figure 2E:
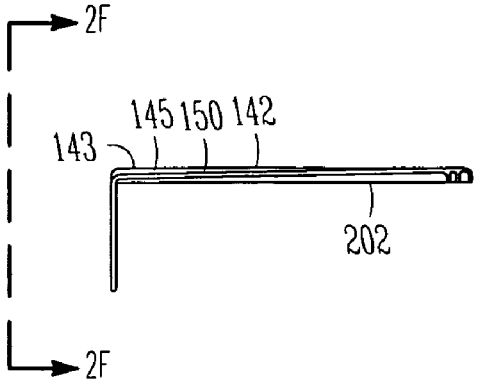
FIG. 2E illustrates a side elevational view of FIG. 2D.
Figure 2F:
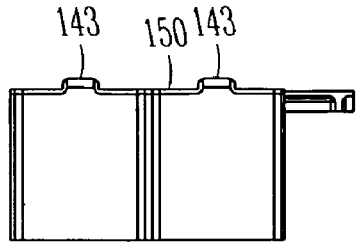
FIG. 2F illustrates a front view taken along 2F-2F of FIG. 2E.
Figure 2G:
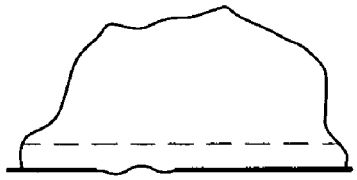
FIG. 2G illustrates a detail taken at 2G of FIG. 2D.
Figure 2H:
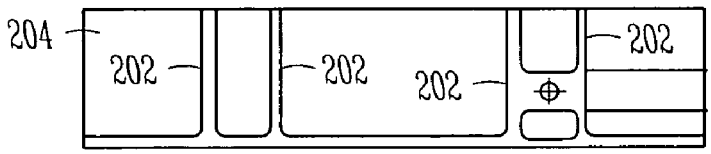
FIG. 2H illustrates a view taken along 2H-2H of FIG. 2I.
Figure 2I:
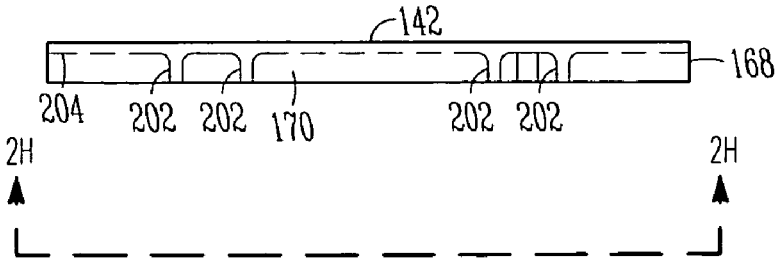
FIG. 2I illustrates a rear view taken along 2I-2I of FIG. 2D.

Optionally, the channels 150 have corresponding non-planar profiles 202 along the underside 204 (e.g., lower surface) of the members 120, 122, 200 (e.g., the surface facing the framework of a rough opening in a wall), as shown in FIGS. 2E, I, H. The channels 150 and the profiles 202 are formed during formation of the members 120, 122, 200, in another option. In yet another option, the profiles 202 are extensions of the wall surfaces 145 extending around the channels 150, as shown in FIG. 2E. The non-planar geometry of the profiles 202 allow for airflow underneath the members 120, 122, 200 and thereby assist in evaporating any fluid or moisture that accumulates (e.g., by condensation) between the members and the framework.

Figure 4C:
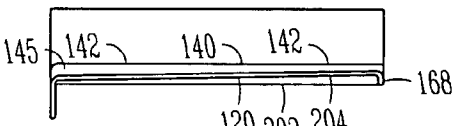
FIG. 4C illustrates a cross section taken along 4C-4C of FIG. 4B.
Figure 4D:
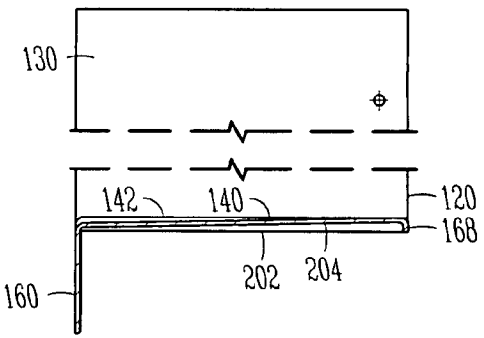
FIG. 4D illustrates a cross section taken along 4D-4D in FIG. 4B.
Figure 4A:
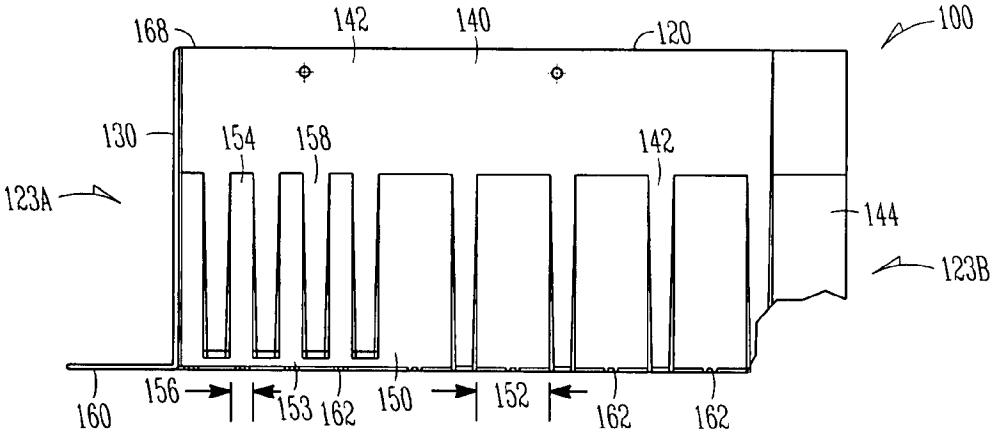
FIG. 4A illustrates a top plan view of a first side member of the flashing assembly as constructed in accordance with at least one example.
Figure 4B:
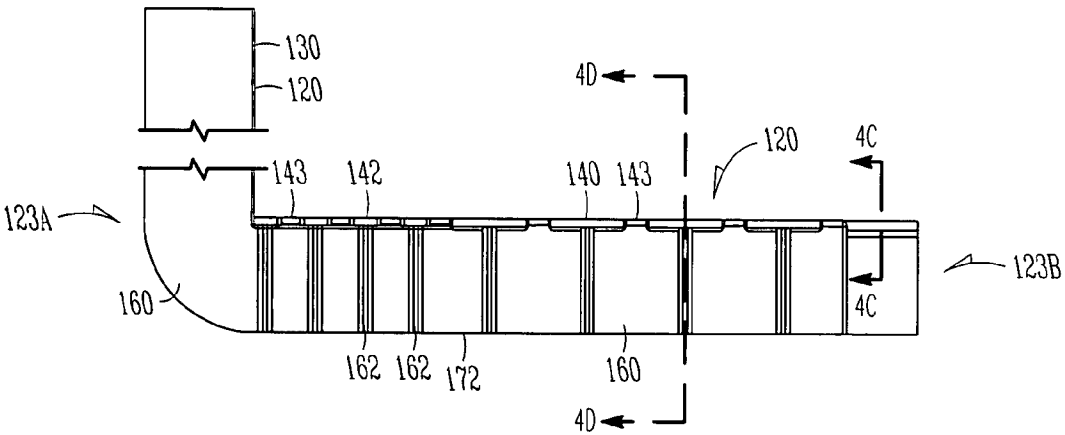
FIG. 4B illustrates a front elevational view of the first side member shown in FIG. 4A.
Figure 4F:
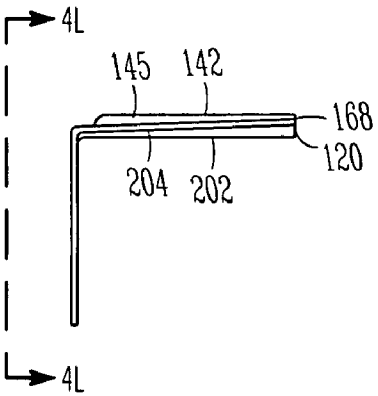
FIG. 4F illustrates a cross section taken along 4F-4F in FIG. 4E.
Figure 4H:
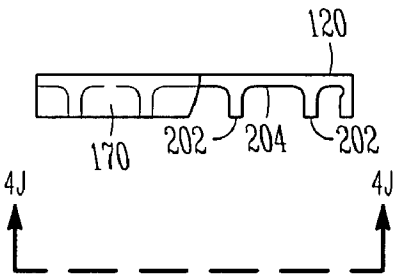
FIG. 4H illustrates a view taken along 4H-4H of FIG. 4E.
Figure 4E:
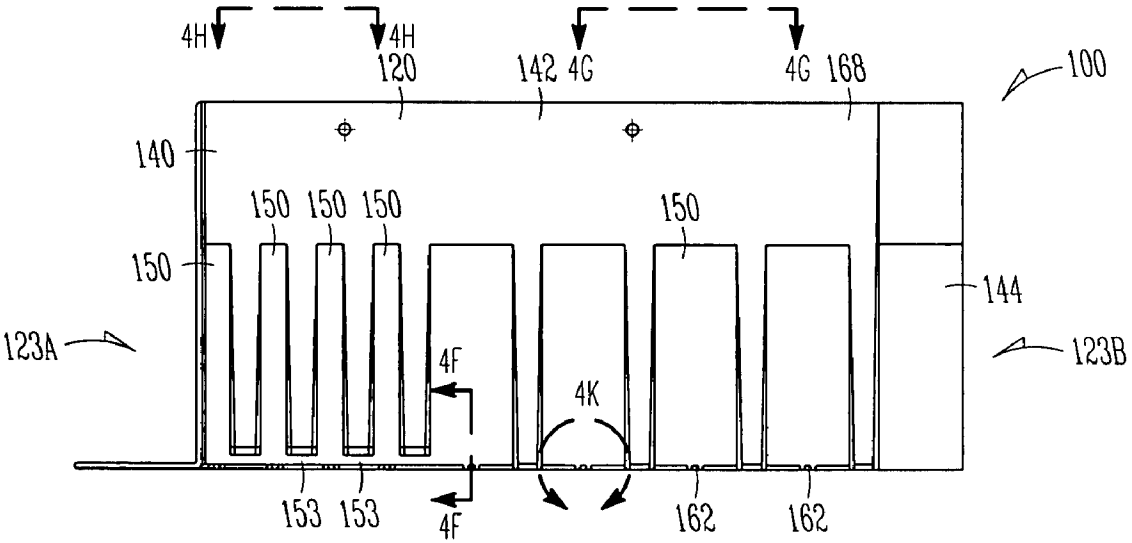
FIG. 4E illustrates a top plan view of the first side member of the flashing assembly.

Referring now to FIGS. 4A-4L, one example of the first side member 120 is shown in greater detail. This example of the first side member 120 includes a side flange 130, a top portion 140, and a front flange 160 (FIGS. 4A, B, D). The terms side, front, top, back and the like are not intended as limiting terms, but instead illustrate the relative disposition of the components. The first side member 120 (and second side member 122) extend from a first end 123A to a second end 123B. In one option, the height of the side flange 130 is about 4 inches, however, it is not so limited. The side flange 130 is contiguous, in one option, with the top portion 140, which collects the water and directs it out to the drainage plane. The side flange 130, in another option, is formed of a flexible material, such as rubber. This facilitates flexing of the side flange 130 during and after installation, and provides ease in shipping the assembly. Optionally, the side flange 130 is separate from the remaining portions of the member, assisting in packaging issues.

The top portion 140 includes a mounting surface 142 upon which a window assembly is supported, as shown in FIGS. 4A-E. The mounting surface 142 provides a relatively flat surface that supports a window assembly installed over the flashing assembly 100. The mounting surface 142 is substantially flat, including the front portions and the rear portions (e.g., between a rear edge 168 and the front flange 160), such that the window assembly may be shimmed into place. For instance, the mounting surface 142 is substantially parallel with at least a portion of a non-planar profile 202 extending along an underside 204 (e.g., lower surface) of the first side member 120 (FIGS. 4C, D, F, H, J). In one option, the mounting surface 142 is substantially parallel with the lower most portion of the profile 202 (i.e., the portion of the profile engaged with the bottom portion of the rough opening), and thereby provides a level surface for receiving the window assembly after installation of the flashing assembly 100 in the rough opening. As described above, in one option, the profiles 202 of the flashing assembly 100 (e.g., members 120, 122, 200) extend along the channels 150 on the underside 204 of the members (FIGS. 4C, D, F, I). As shown in FIGS. 4C, F, the profiles 202 are extensions of the wall surfaces 145 that surround portions of the channels 150, in another option.

The top portion 140 further includes a coupling portion 144, such as a recessed surface. The coupling portion 144 allows for the first side member 120 to be coupled with either the second side member 122 (FIGS. 1A, B) or the interconnecting member 200 (FIGS. 1A, B). The coupling portion 144 facilitates coupling of the members 120, 122, 200 such that drainage occurs without leakage from the flashing assembly 100. In another option, the coupling portion 144 allows for trimming and sealing together of at least two of the members 120, 122, 200, as further described below. In yet another option, the top portion 140 includes anchor features 203 including, but not limited to, holes, recesses and the like (FIG. 41). The anchor features 203 are sized and shaped to receive fasteners that couple the flashing assembly 100 members with the framework of a rough opening. In one example, nails, screws and the like are driven through the anchor features 203 and into the rough opening framework, thereby coupling the flashing assembly 100 within the rough opening.

As described above, the top portion 140 includes one or more channels 150, as shown in FIGS. 4A-E. The one or more channels 150 include a slope from the back towards the front of the member 120, thereby facilitating run off of liquids, such as water. The slope of the channels 150 occurs underneath a portion of the mounting surface 142, such that drainage can occur beneath the mounting surface 142 without contacting the window assembly installed over the flashing assembly 100. Optionally, the one or more channels 150 can have a variety of widths 152, 156 with respect to other channels. In one option, one or more channels 150 have a first width that is larger than one or more channels 154 that have a second width 156. In one example, the first width 152 of a first channel is three times as great than the second width 156 of a second channel. In another example, the first width 152 of a first channel is two times as great as the second width 156 of a second channel. Optionally, other ratios of widths 152, 154 are used. The variation in widths allows for advantages for use with the flashing assembly 100. For instance, having a lesser width (e.g., width 156) near the side flange 130 provides greater support and strength for the corner portions of the flashing assembly 100 because of additional raised portions (described below) and corresponding profiles 202 of the channels 154 at the flange 130. The greatest stresses are applied near the side flange 130 by the window assembly after installation, and the additional profiles 202 and raised portions distribute these stresses. In another example, the variation in widths provides greater flexibility in designing the coupling portions (described below) and features for coupling together the various flashing members 120, 122, 200 (e.g., surface area of the coupling portions and the like).

Referring now to FIGS. 4A-F, disposed between the plurality of channels 150, are raised portions 143. In one option, the raised portions 143 surround at least a portion of the channels 150. The raised portions 143 form a portion of the mounting surface 142 and are sized and shaped to provide support to the window mounted thereon. In another option, the raised portions 143 have substantially similar widths as illustrated in FIG. 4A. In another option, other varying widths can be used for the raised portions 143.

Referring now to FIGS. 4A, E, in another option, at least one member of the flashing assembly 100 further includes cross channels 153 that interconnect one or more of the channels 150. In still another option, the cross channel 153 is substantially perpendicular to the channels 150. The cross channels 153, in one option, are approximately disposed along a middle portion of the raised portions 143, and extend through the raised portions 143. Optionally, the cross channels 153 are disposed along the raised portions at any location (e.g., toward the rear edge 168, the front flange 160 and the like). For example, the cross channels are disposed along the front edge portion, as illustrated in FIG. 4A. In another option, the cross channels 153 are disposed along at least one of the top portion 140 and the front flange 160 (e.g., interconnecting the recesses described below). In one option, the cross channels 153 fluidly interconnect a plurality of channels 150. Interconnecting the plurality of channels 150 with the cross channels 153 ensures that liquids, such as water, drain from beneath the window assembly despite blockages from debris in some of the channels 150. The cross channels 15 route the liquid to unobstructed channels 150. Additionally, the cross channels 153 do not interconnect with channels 150 near the coupling portion 144. In yet another option, the cross channels 153 are separated from the coupling portion 144 by a portion of the member (e.g., members 120, 122, 200), such as a raised portion 143. The cross channels 153 extend away from the coupling portion 144, for instance toward an opposed end of the member. This allows for trimming of the side member 120 such that the side member 120 can be used in multiple lengths with an opposing side member 122 and/or the interconnecting member 200 without having the cross channel 153 in communication with the coupling portion 144. For example, trimming the side member 120 along a channel 150 separated from the cross channel 153 allows the separated channel 150 to act as the coupling portion 144. Separating the cross channel 153 from the coupling portion 144 ensures the cross channel 153 routes liquids away from the coupling portion 144, and assists in preventing leaking at the coupling portion.

Figure 4G:
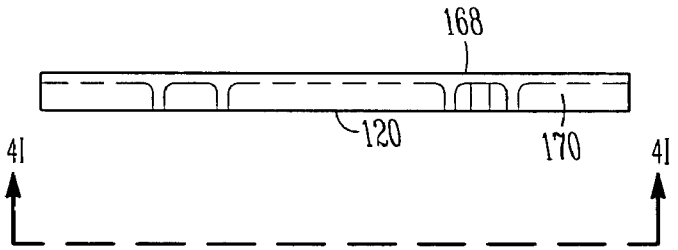
FIG. 4G illustrates a view taken along 4G-4G of FIG. 4E.
Figure 4J:
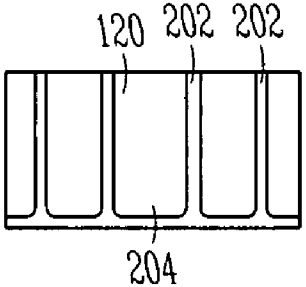
FIG. 4J illustrates the view taken along 4J-4J of FIG. 4H.
Figure 4L:
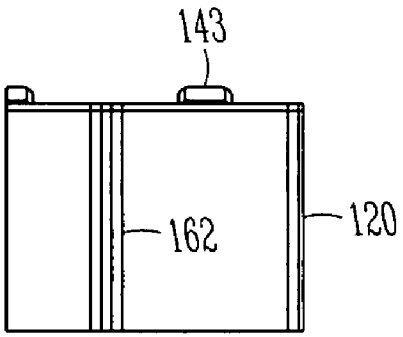
FIG. 4L illustrates a view taken along 4L-4L of FIG. 4F.
Figure 4I:
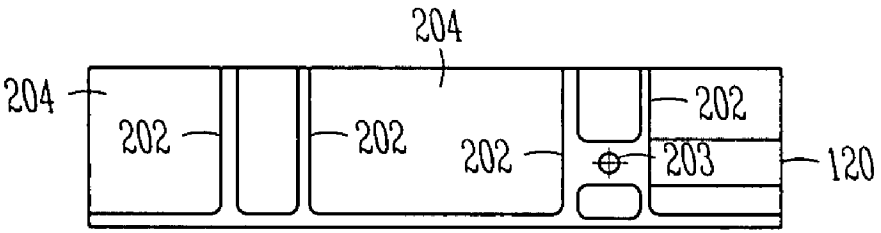
FIG. 4I illustrates the view taken along 4I-4I of FIG. 4G.
Figure 4K:
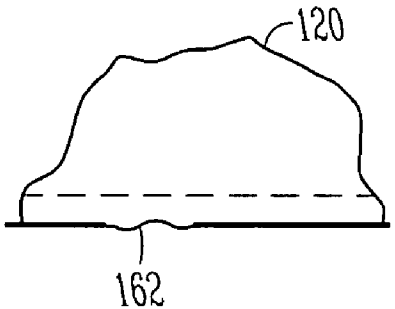
FIG. 4K illustrates a detail taken at 4K of FIG. 4E.

As shown in FIGS. 4A, E, the one or more channels 150 of the flashing members (e.g., members 120, 122, 200) slope downward from the mounting surface 142 toward the front flange 160 of the members. This allows liquids, such as water, to drain away from the mounting surface 142 toward the front flange 160, and optionally down the front flange 160. In one option, the channels 150 extend along the top portion 140 between the rear edge 168 and the front flange 160. The front flange 160 optionally drains between an outer siding and an outer building wrap such as TYVEK®. The front flange 160 includes optional features. For example, the front flange 160 includes one or more drainage recesses 162, as shown in FIGS. 4A, B, E, K, providing additional drainage for the side member 120. In another example, one or more drainage recesses 162 are interconnected with the fluid path formed by the one or more channels 150, thereby forming composite channels extending along the top portion 140 between the rear edge 168 and a lower edge 172 (FIG. 4B) of the front flange 160. In another example, the one or more recesses 162 are disposed along the front flange 160 such that one recess 162 is substantially aligned with each channel 150. One example of a cross section of one or more recesses 162 is shown in FIG. 4K and includes a curve portion without, for example, sharp edges, allowing for fluid to flow thereover. The one or more recesses 162, in another option, are interconnected with the cross channels 153 such that the fluid draining from the channels 150 can drain along the cross channels 153 and ultimately drain down one or more of the drainage recesses 162. In one example, the cross channels 153 extend across the front flange 160 and interconnect the recesses 162. The drainage recesses 162 allow for drainage of fluids along the front flange 160 where a nailing flange, siding and the like are lapped against the front flange 160. For instance, a nailing flange, siding and the like engages the front flange 160 while the recesses 162 remain unobstructed and able to drain fluids.

Figure 16:
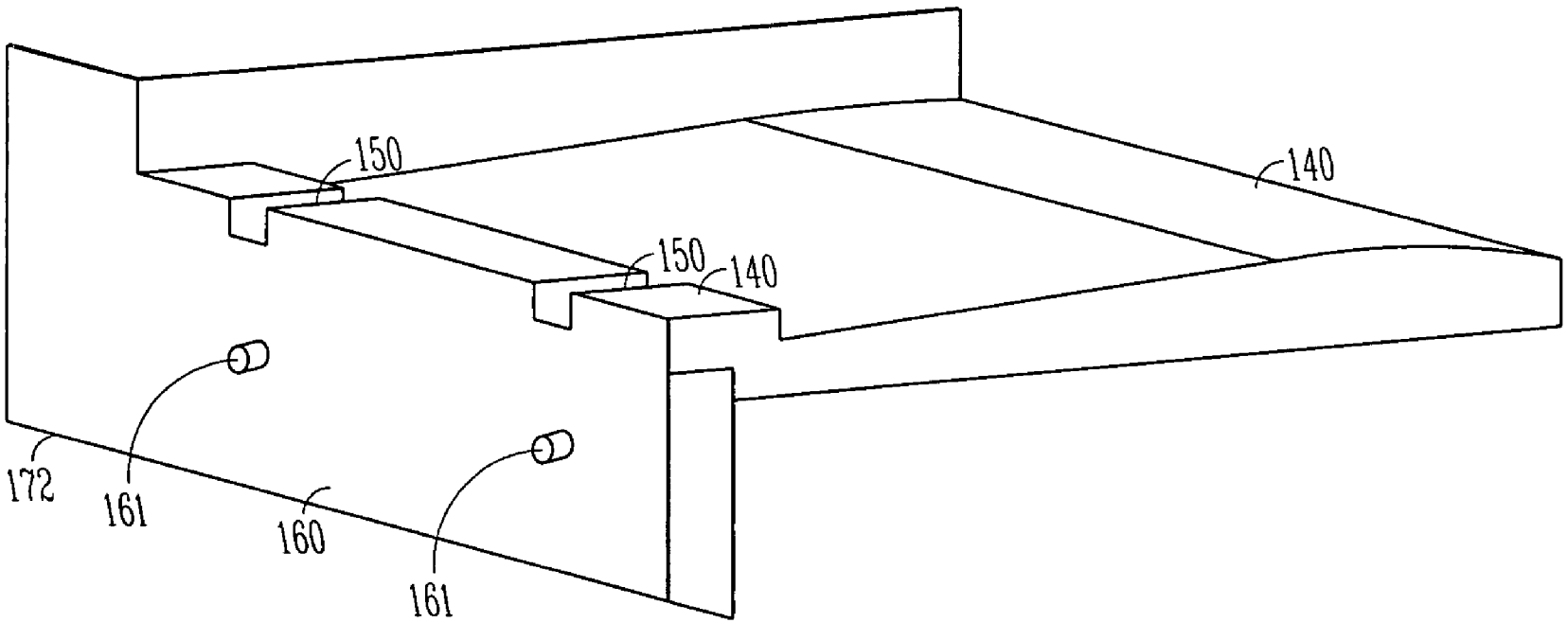
FIG. 16 illustrates a perspective view of an example first side member of a flashing assembly constructed in accordance with at least an additional example.

Referring now to FIG. 16, disposed along the front flange 160, in another option, are a number of projections 161 (FIG. 16). The projections 161 allow for drainage to occur from the channels 150 down the front flange 160, for example, between the outer siding and the outer house wrap (e.g., TYVEK®). In yet another option, the one or more projections 161 include circular projections (e.g., buttons, knurling and the like). In still another option, the projection 161 is a non-channel type of projection, and thereby provides a drainage path across the majority of the front flange 160 toward the lower edge 172. In yet another option, the projection 161 does not extend to an end of the member (e.g., members 120, 122, 200), such as ends 123A, B. Optionally, the projection 161 does not extend to at least one of the lower edge 172 of the front flange 160 and the top portion 140.

Opposite the front flange 160 of the side member 120 is the rear edge 168. In one option, the rear edge 168 includes a lower extending lip 170, as shown in FIG. 4G. The lower extending lip 170 assists in providing a finished looking appearance to the flashing assembly when it is installed. In one example, the lower lip 170 faces the interior of the building, and provides a finished look to a person inside of the building (i.e., the lower lip 170 conceals the non-planar profile 202 and spaces therebetween).

The first side member 120 has been described in detail and shown in detail in the Figures. The second side member 122 is substantially similar to the first side member, in one option. The second side member 122, in one option, includes all of the features described above as for the first side member 120. It should be noted, however, that the second side member 122 need not be identical to the first side member 120. The second side member 122 is formed with the side flanges extending in the different directions so that the second side member 122 can be used on the opposite side of the first side member 120 in a rough opening.

As mentioned above, an interconnecting member 200 is optionally disposed between the first side member 120 and the second side member 122. The at least one interconnecting member 200 is shown in detail in FIGS. 2A through 21. The interconnecting member extends between a first end 206A and a second end 206B, and has a top portion 140 and a front flange 160, as shown in FIGS. 2A, B, D. In one option, the at least one interconnecting member 200 includes many of the same or similar features as the first side member 120 (FIGS. 1A, B, 4A-L), shown in the corresponding FIGS. (2A-L). For example, as shown in FIGS. 2A, D, I, the interconnecting member 200 includes a rear edge 168 similar to the rear edge of the side member 120 (described above). The rear edge 168 includes a lower extending lip 170, as shown in FIGS. 2C, I. The lower extending lip 170 assists in providing a finished looking appearance to the flashing assembly 100 when it is installed. In one example, the lower lip 170 faces the interior of the building, and provides a finished look to a person inside of the building (i.e., the lower lip 170 conceals the profile 202 and spaces therebetween).

The top portion 140, in one option, includes a coupling portion 146 sized and shaped to couple with at least one coupling portion 144 of the side members 120, 122, shown in FIGS. 2A, D. Optionally, the coupling portion 146 is lapped over the coupling portion 144 and a sealant is applied therebetween. The coupling portion 146 facilitates coupling of the members 120, 122, 200 such that drainage occurs without leakage from the flashing assembly 100. In another option, the coupling portion 146 allows for trimming and sealing together of at least two of the members 120, 122, 200, as further described below. The at least one interconnecting member 200 is trimmed, for example, through a portion of one of the channels 150. This allows shortening of the interconnecting member 200 and use of the member 200 and side members 120, 122 in a variety of rough openings in combination with a variety of window sizes. In one example, the interconnecting member 200 is trimmed along at least a portion of the line illustrated as K-K in FIG. 2D. This forms the coupling portion 146 sized and shaped for coupling (e.g., by lapping and adhering) with coupling portion 144 of one of the side members 120, 122.

As described above and shown in FIGS. 2A, B, D, the interconnecting member 200 includes one or more channels 150 that allow for liquid, such as water, to be directed outside of the window system and into the drainage plane (e.g., along the front flange 160 and between a house wrap and siding). As shown in FIGS. 2C, E, the one or more channels 150 include a slope from the back towards the front of the member 200, thereby facilitating run off of liquids, such as water. The slope of the channels 150 occurs underneath a portion of a mounting surface 142 (described below), such that drainage can occur beneath the mounting surface 142 without contacting the window assembly installed over the flashing assembly 100.

The mounting surface 142 is substantially flat, including the front portions and the rear portions (e.g., between a rear edge 168 and the front flange 160), such that the window assembly may be shimmed into place. For instance, the mounting surface 142 is substantially parallel with at least a portion of a non-planar profile 202 extending along an underside 204 (e.g., lower surface) of the interconnecting member 200 (FIGS. 2C, E, I, H). In one option, the mounting surface 142 is substantially parallel with the lower most portion of the profile 202 (i.e., the portion of the profile engaged with the bottom portion of the rough opening), and thereby provides a level surface for receiving the window assembly after installation of the flashing assembly 100 in the rough opening.

Referring now to FIGS. 2A-F, disposed between the plurality of channels 150, are raised portions 143. In one option, the raised portions 143 surround at least a portion of the channels 150. The raised portions 143 form a portion of the mounting surface 142 and are sized and shaped to provide support to the window mounted thereon. In another option, the raised portions 143 have substantially similar widths as illustrated in FIG. 2A. In another option, other varying widths can be used for the raised portions 143.

Referring again to FIGS. 4A, E, in another option, at least one member of the flashing assembly 100 includes cross channels 153 that interconnect one or more of the channels 150. The cross channels 153 fluidly interconnect a plurality of channels 150 ensuring that liquids, such as water, drain from beneath the window assembly despite blockages from debris in some of the channels 150. The cross channels 153 route the liquid to unobstructed channels 150. Additionally, the cross channels 153 do not interconnect with channels 150 near the coupling portions 144, 146, described above (FIGS. 2A, E, 4A, E). Optionally, the cross channels 153 are separated from the coupling portions 144, 146 by a portion of the member (e.g., members 120, 122, 200), such as the raised portion 143. This allows for trimming of the members 120, 122, 200 such that the members can be used in multiple lengths with an opposing side member 122 and/or the interconnecting member 200 without having the cross channel 153 in communication with the coupling portions 144, 146. For example, trimming one of the members 120, 122, 200 along a channel 150 separated from the cross channel 153 allows the separated channel 150 to act as the coupling portion 144, 146. Separating the cross channel 153 from the coupling portions 144, 146 ensures the cross channel 153 routes liquids away from the coupling portion 144, 146 and assists in preventing leaking at the coupling portions.

Figure 5:
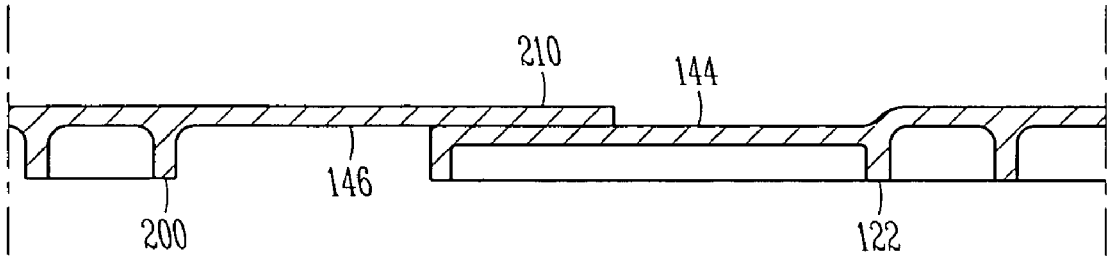
FIG. 5 illustrates a portion of the interconnecting member in a second side member of the flashing assembly constructed in accordance with at least one example.

FIG. 5 illustrates one example of an interconnection between a second side member 122 and the interconnecting member 200 at the coupling portions 144, 146. As shown in the illustration, the interconnecting portion includes a substantially flat portion 210, between which adhesive can be disposed allowing for a superior joining process to occur between the interconnecting member 200 and the second side member 122.

The above described flashing assembly 100 provides many features which allow for drainage from a window assembly to occur efficiently to a drainage plane As described above, in one option, the drainage plane occurs between the outer siding and an outer wrap around the building, for example, TYVEK®. It should be noted, however, that other drainage planes can be used as well (e.g., between stucco and a wrap, cladding and a wrap and the like). Several other features are contemplated for the flashing assembly 100 many of which are illustrated in FIGS. 6 through 21.

Figure 6:
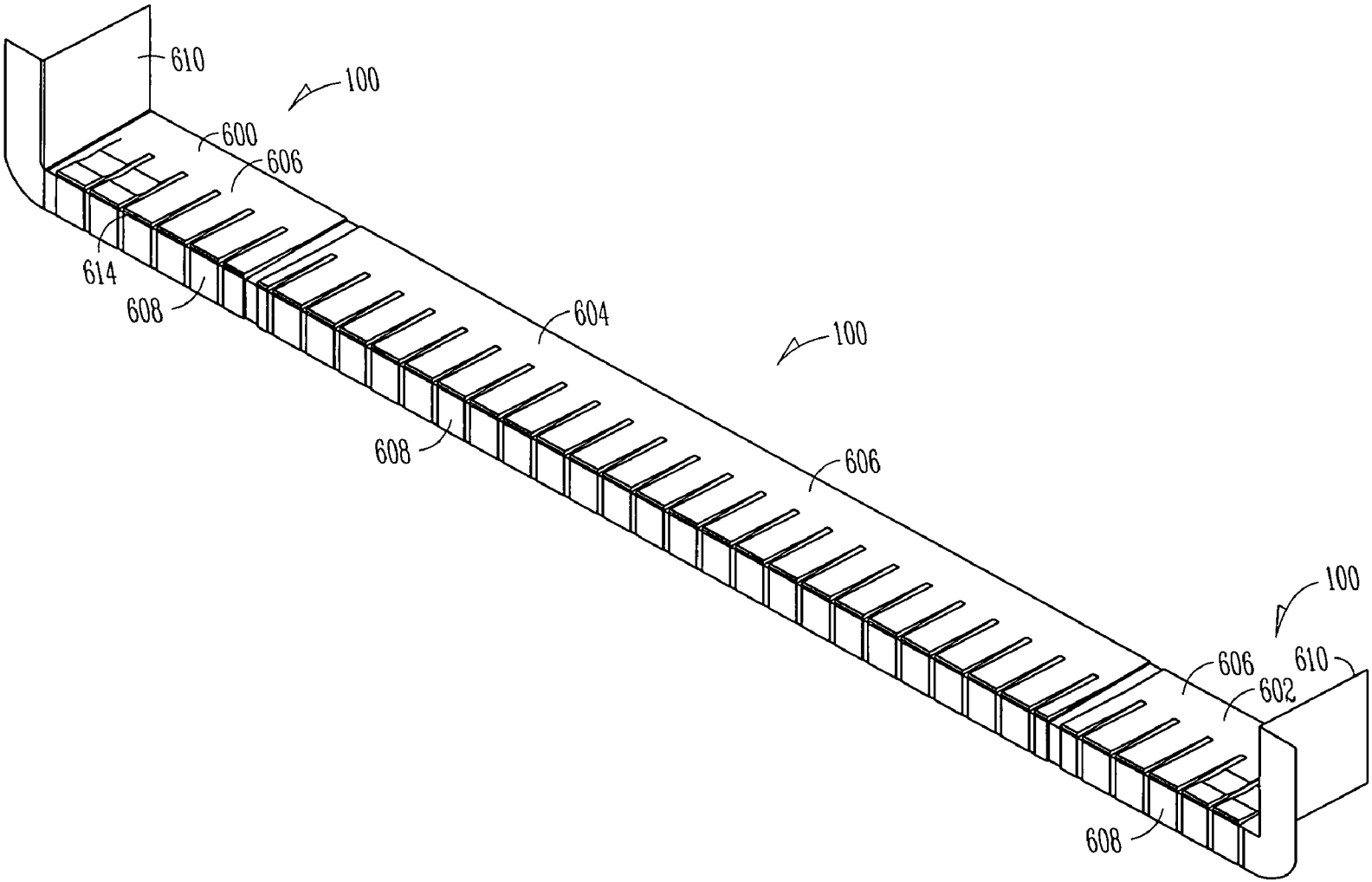
FIG. 6 illustrates a perspective view of a flashing assembly constructed in accordance with at least one example.

FIG. 6 shows one example of a flashing assembly 100 including side members 600, 602 and an interconnecting member 604 therebetween. The members are similar in at least some respects to the members 120, 122, 200 described above. Each of the members 600, 602, 604 includes a top portion 606 and front flange 608. The side members 600, 602 include side flanges 610 contiguous with the top portion 606.

Figure 7A:
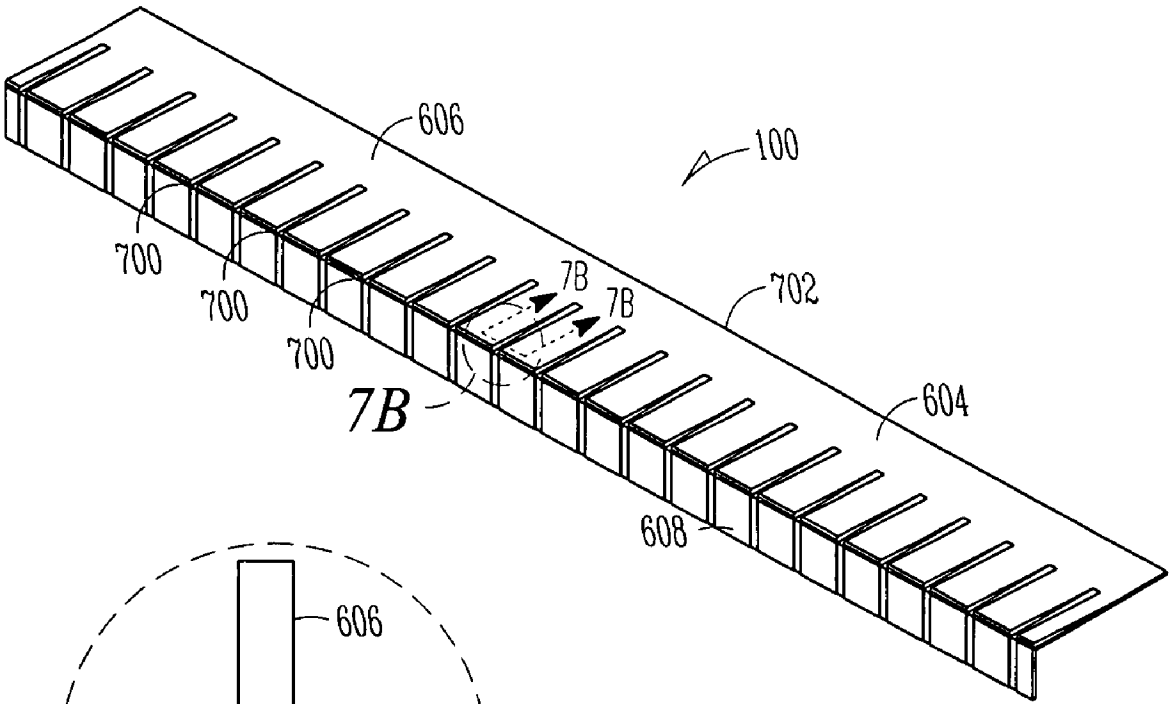
FIG. 7A illustrates a perspective view of an interconnecting member constructed in accordance with at least one example.
Figure 7B:
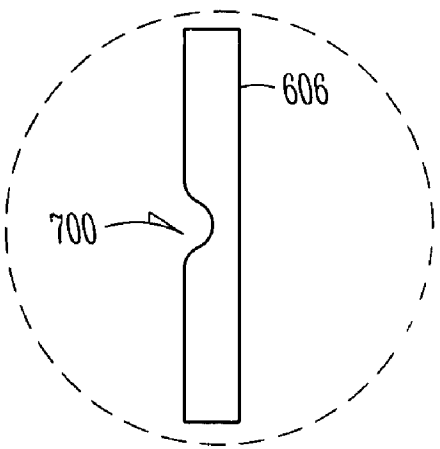
FIG. 7B illustrates a detail sectional of a channel of the interconnecting member taken along line 7B-7B in FIG. 7A.

Referring now to FIGS. 7A, B, channels 700 of the interconnecting member 604 are shown. The channels 700 are similar in at least some respects to the channels 150 of the members 120, 122, 200, described above. The channels 700 slope from a rear edge 702 of the interconnecting member 200 toward the front flange 608, thereby facilitating movement of liquid away from a window assembly installed over the interconnecting member 700. The side members 600, 602 include similar channels. As shown in FIG. 7B, the channels 700 are formed in the top portion 606. The material of the top portion 606 is thinner at the channel 700 to provide the desired depth, slope and length of the channel 700, in one option. In another option, the material of the top portion around the channel 700 has the same thickness as the majority of the top portion. Optionally, the channels 700 are formed by molding, machining and the like.

Figure 8:
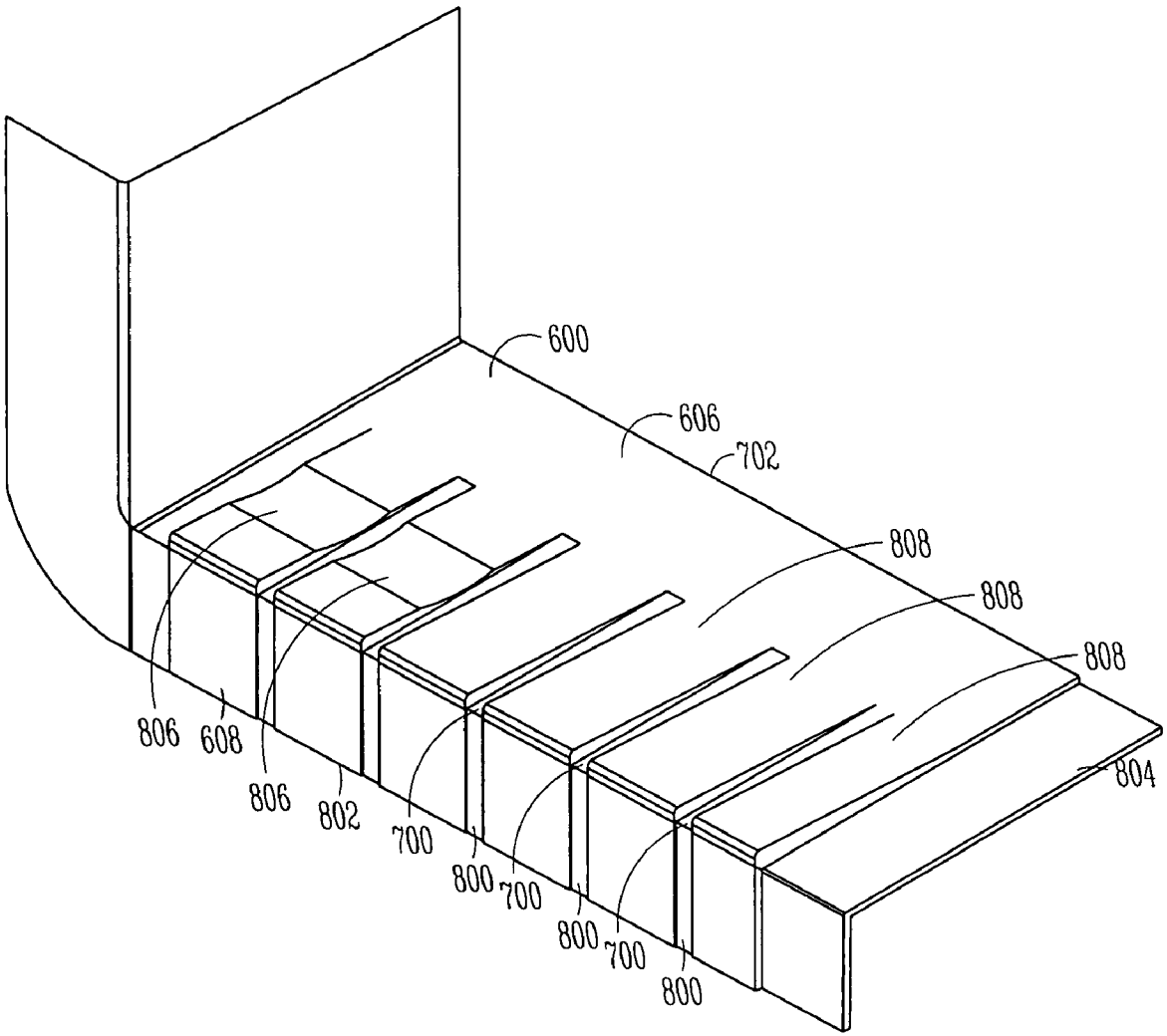
FIG. 8 illustrates a perspective view of a side member of a flashing assembly constructed in accordance with at least one example.

FIG. 8 shows one example of the side member 600 including channels 700 extending along the top portion 606. As shown, the channels 700 extend between the rear edge 702 of the side member 600 to the front flange 608. The channels 700 are sloped to facilitate movement of liquids, such as water toward the drainage plane (i.e., toward the front flange 608 and the area between an outer wrap of a building and siding). The channels 700 are in communication, in one option, with recesses 800 extending along the front flange 608 from the top portion 606 to the lower edge 802 of the front flange 608. The recesses 800 and channels 700 form composite channels extending along at least a portion of the top portion 606 and the front flange 608. The recesses 800 permit lapping of construction materials such as siding, cladding, stucco and the like against the front flange 608 while still allowing liquid to run down the front flange 608.

The side member 600 includes a coupling portion 804, in another option. The coupling portion 804 is similar in at least some respects to the coupling portion 144, described above. As shown in FIG. 8, the coupling portion 804 includes a surface recessed back from the top portion 606 and the front flange 608. The coupling portion 804 is sized and shaped to receive a corresponding coupling portion from a similar member (e.g., interconnecting member 604 and side member 602) to form a substantially continuous flashing assembly 100 across a rough opening in a building.

Figure 9:
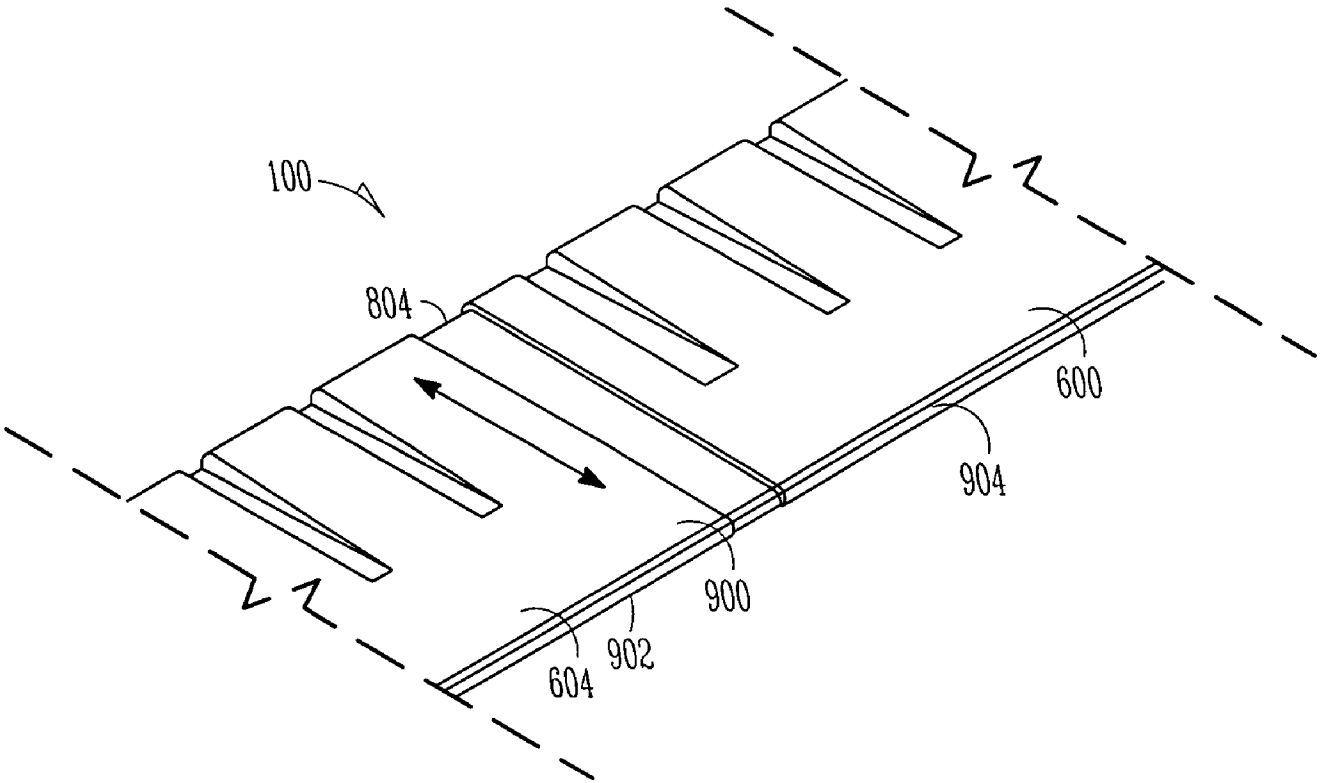
FIG. 9 illustrates a perspective view of an interconnecting portion between a side member and interconnecting member of a flashing assembly constructed in accordance with at least one example.
Figure 10:
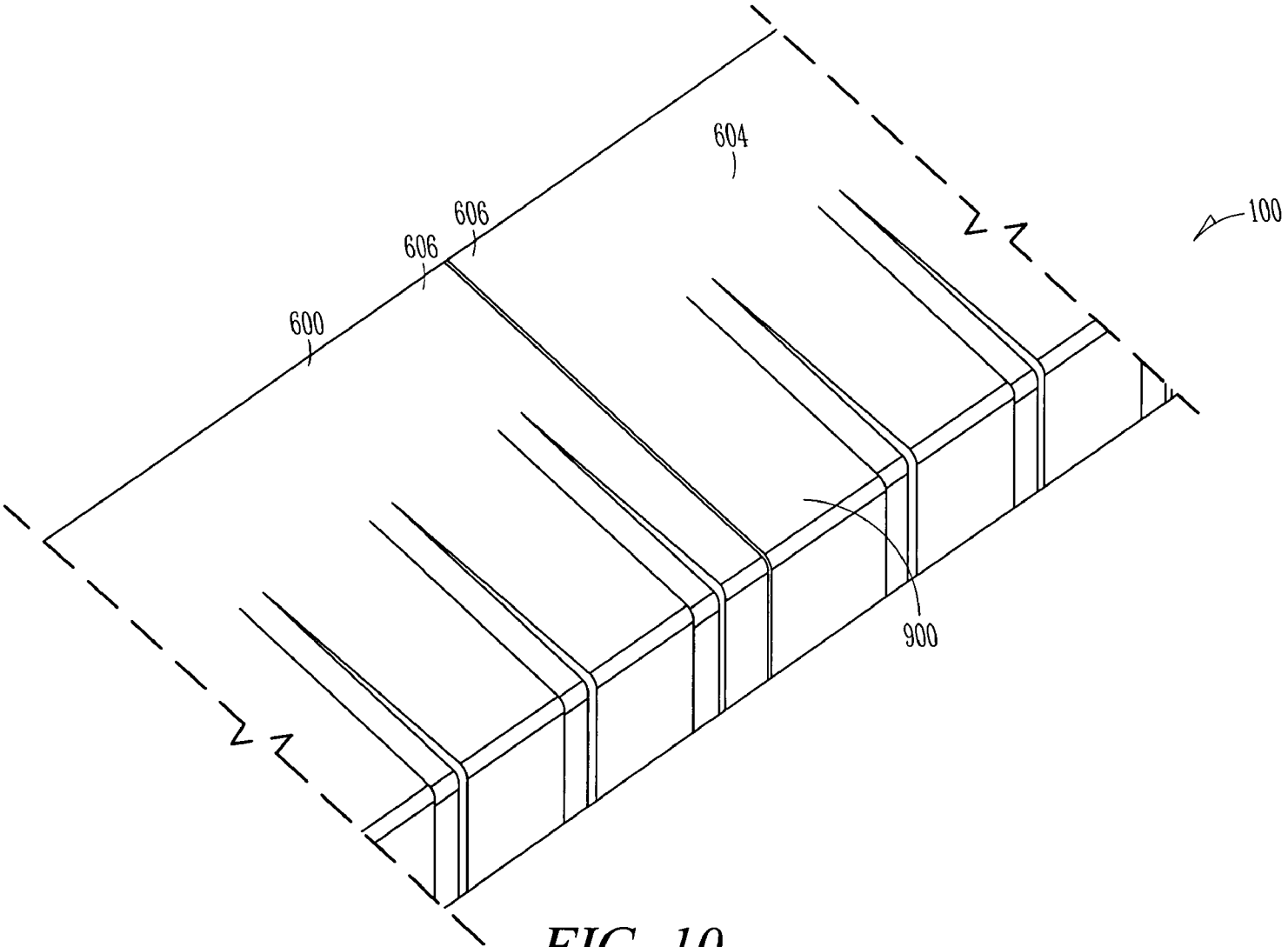
FIG. 10 illustrates a perspective view of an interconnecting portion between a side member and interconnecting member of a flashing assembly constructed in accordance with at least one example.

FIG. 9, shows one example of the coupling between members of the flashing assembly 100. In one option, the side member 600 is coupled with the interconnecting member 604, as shown in FIG. 9. In another option, the side member 600 is coupled with the side member 602. A second coupling portion 900 of the interconnecting member 604 is lapped over a portion of the coupling portion 804 of the side member 600. The interconnecting member 604 includes a lip 902 sized and shaped to extend over the corresponding lip 904 of the side member 600 when the members are coupled together. The lip 902 cooperates with the front flange 608 (FIG. 6) to prevent relative movement between the interconnecting member 604 and the side member in the direction of the arrows shown in FIG. 9. Adhering the interconnecting member 604 with the side member 600 at the coupling portions 804, 900 restrains movement of the members along the length of the flashing assembly 100 and thereby ensures coupling of the members of the assembly 100. As shown in FIG. 10, the interconnecting member 604 and the side member 600 are coupled together and the coupling portion 900 of the member 604 conceals the coupling portion 804 of the side member 600 thereby providing a continuous top portion 606 for the flashing assembly 100. In one option, the coupling portions 900, 804 are sealed together with an adhesive. The adhesive and concealment of the coupling portion 804 substantially prevent ingress of liquids from the upper surface of the top portion 606 to underneath the top portion 606.

Figure 11:
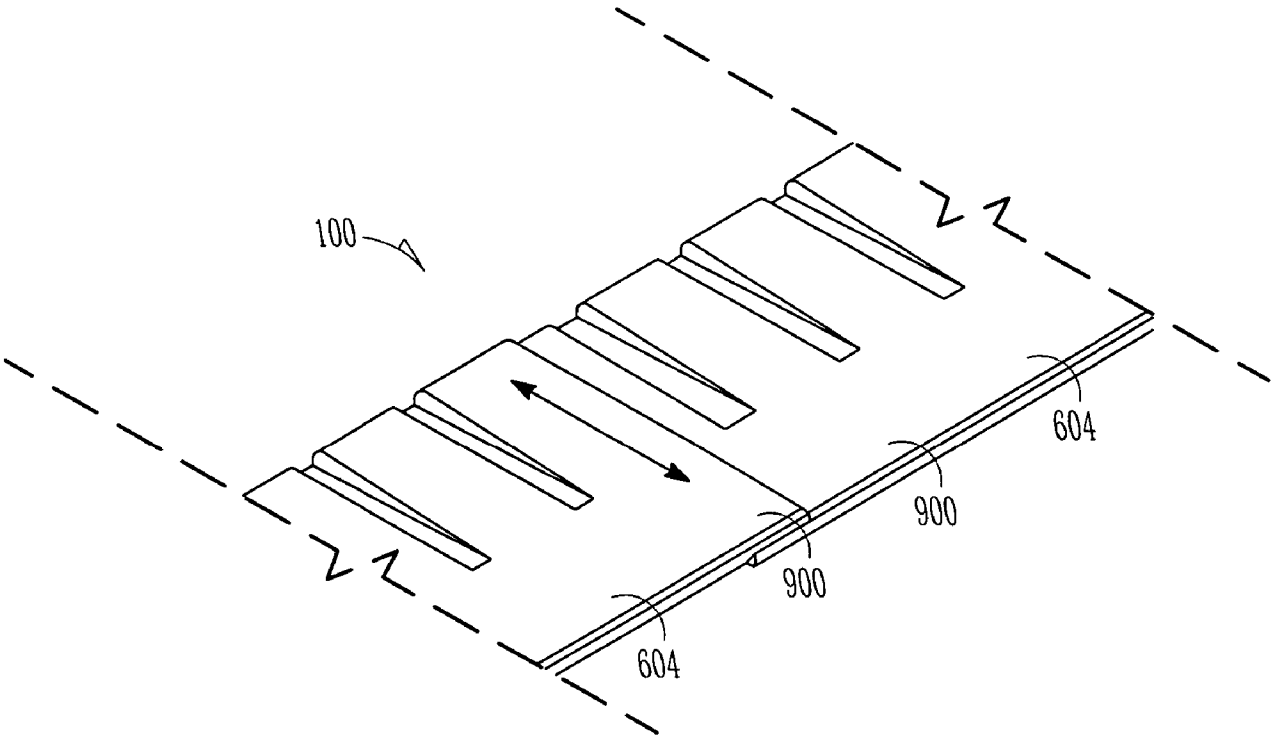
FIG. 11 illustrates a perspective view of two interconnecting members that are interconnecting along the coupling portion of a flashing assembly constructed in accordance with at least one example.

FIG. 11, shows another example of the members for the flashing assembly 100. In one option, the members include an interconnecting member 604 engaged against a second interconnecting member 604. The interconnecting members 604 are shown with an overlap at the coupling portions 900 to allow the interconnecting members 604 to fit within a rough opening in a building. In another option, the interconnecting members 604 are lapped as shown and adhered, as described above. Optionally, at least one of the interconnecting members 900 is trimmed along the top portion 606 and the front flange 608 (FIG. 6) to provide a continuous unbroken top portion 606 and front flange 608.

Figure 12:
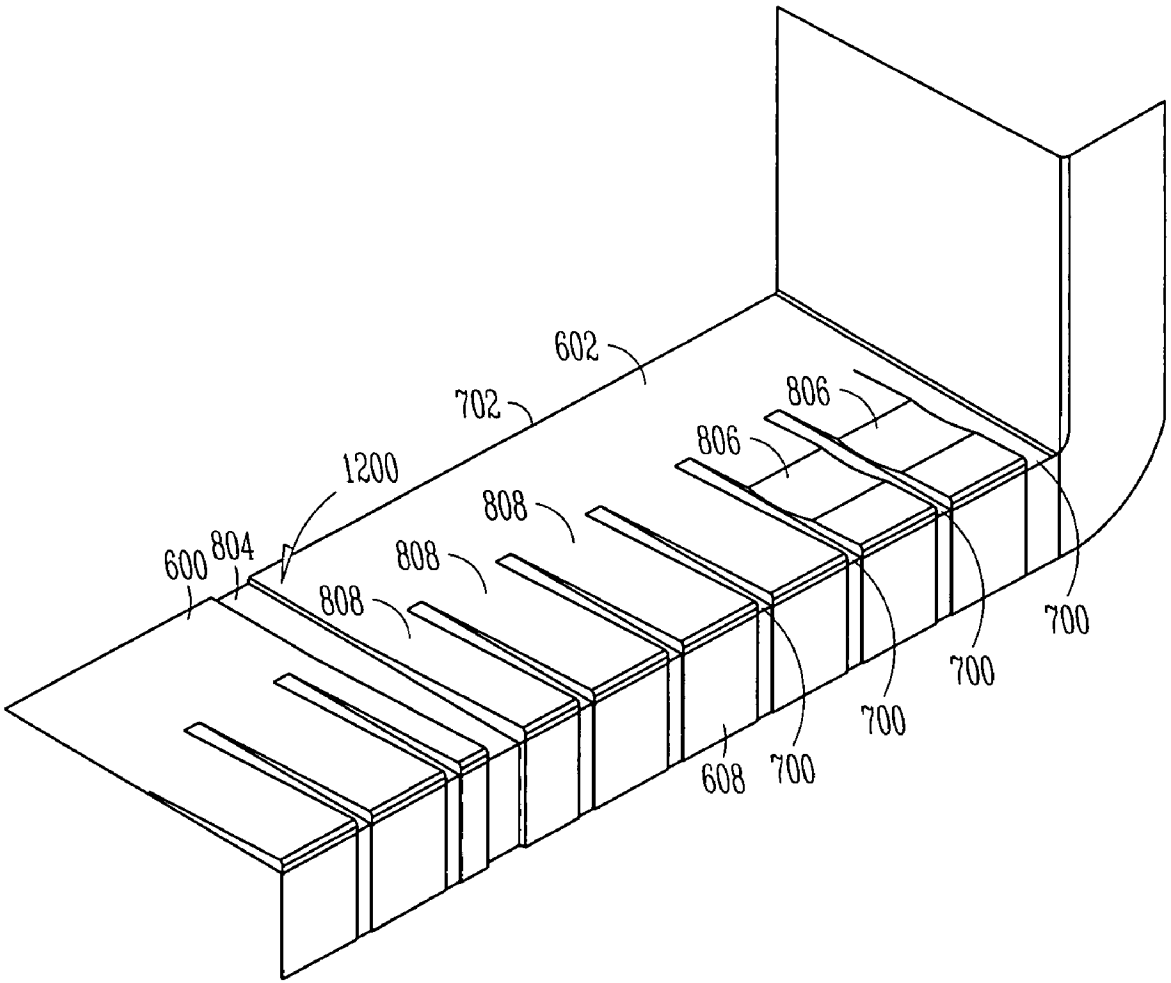
FIG. 12 illustrates a perspective view of an interconnecting portion between a first side member and a second side member of a flashing assembly constructed in accordance with at least one example.

In FIG. 12, side members 600, 602 are coupled together without the interconnecting member 604 therebetween. As shown, the side member 600 includes the coupling portion 804. The side member 602, in one option, includes a coupling portion 804 as well. The coupling portion 804 of the side member 602 is removed, in another option, for instance by trimming the side member 602 to provide a coupling portion 1200 similar to the coupling portion 900 (FIG. 9) described above for the interconnecting member 604. The trimmed coupling portion 1200 is lapped over the coupling portion 804 and optionally an adhesive is applied therebetween to provide a continuous flashing assembly 100 that moves liquids, such as water, away from an installed window assembly toward a drainage plane. In one example, the drainage plane includes the front flange 608 and the space between an outer wrap of a building and siding (e.g., typical siding, stucco and the like).

Figure 13:
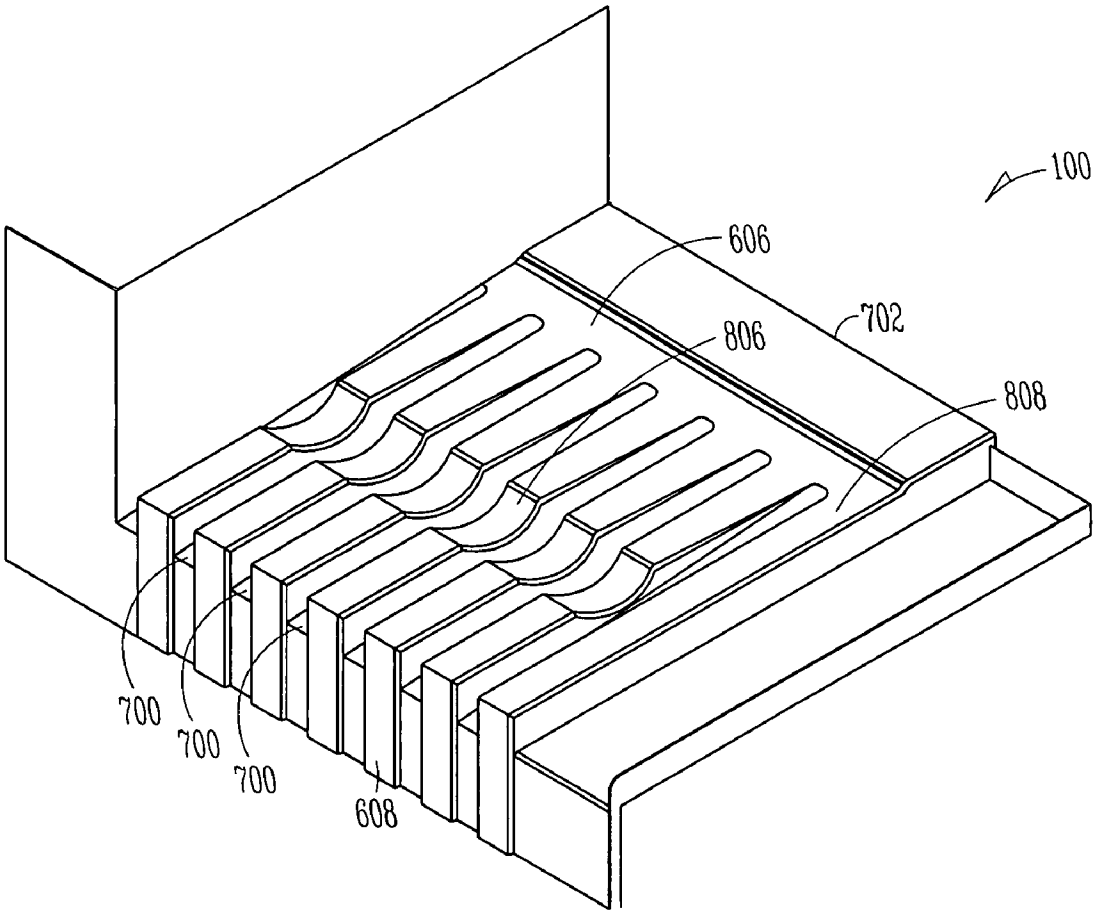
FIG. 13 illustrates a perspective view of a first side member of a flashing assembly constructed in accordance with at least another example.

Referring now to FIGS. 8, 12 and 13, the members of the flashing assembly 100 include channels 700 extending along at least a portion of the top portion 606 between the rear edge 702 of the top portion and the front flange 608. The channels 700 are sloped and thereby move liquids (e.g., water) away from a window assembly installed above the flashing assembly 100. As shown in FIGS. 8, 12 and 13, cross channels 806 extend across two or more of the channels 700 to facilitate fluid communication between the channels 700. The cross channels 806 allow liquids to move between channels 700 to an unobstructed channel 700, for instance, if one or more channels 700 is blocked (e.g., by debris, insects and the like). The cross channel 806 thereby ensures that liquid between the flashing assembly 100 and a window assembly is routed away from the window assembly and down the front flange 608.

In another option, the cross channel 806 is separated from the coupling portion 804, as shown in FIGS. 8, 12 and 13. The cross channel 806, optionally is not in communication with the channels 700 near the coupling portion 804 (i.e., an end of the member). Raised portions 808 that form a portion of a mounting surface to support a window assembly, separate the coupling portion 804 from the cross channel 806. The cross channel 806 thereby routes liquids, such as water, away from the coupling portion 804 and assists in preventing leakage between members (e.g., members 600, 602, 604) at the coupling portion 804.

In still another option, the cross channel 806 is separated from the coupling portion 804 by a plurality of raised portions 808, as shown in FIGS. 8 and 12. Portions of the member (e.g., side member 600) are removed, for instance by trimming along the channels 700 not in communication with the cross channel 806 (i.e., the channels 700 near the original coupling portion), thereby forming customized coupling portions for coupling with other members of the flashing assembly 100. The remaining raised portions 808 continue to separate the cross channel 806 from the newly formed coupling portions. Because the cross channel 806 is not in communication with the channels near the coupling portion 804, removal of portions of the member 600 allows for customization of the members without the cross channel 806 routing water toward the newly formed coupling portions. The customized members (e.g., members 600, 602, 604) allow fitting of the flashing assembly 100 in a variety of rough openings and use with a variety of window configurations.

Figure 14:
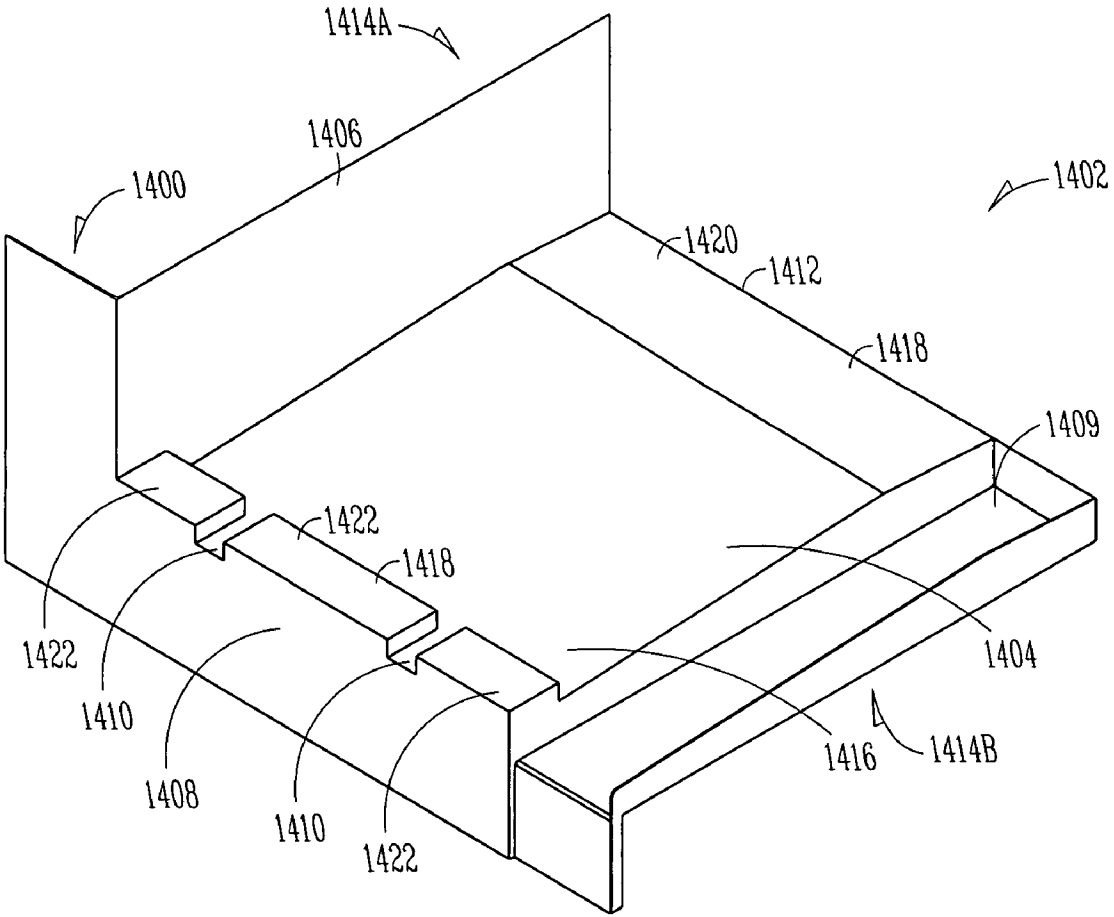
FIG. 14 illustrates a perspective view of a first side member of a flashing assembly constructed in accordance with at least yet another example.

Another example of a flashing assembly 1400 is shown in FIG. 14. A side member 1402 is shown, including a top portion 1404, side flange 1406 and a front flange 1408. At least the top portion 1404 includes channels 1410 extending between a rear edge 1412 of the top portion and the front flange 1408. A cross channel 1416 extends between a first end 1414A and a second end 1414B. The cross channel 1416 is similar in at least some respects to the cross channels described above. For example, the cross channel 1416 communicates with the channels 1410 to facilitate movement of liquids, such as water, therebetween. The cross channel 1416 routes liquids away from blocked channels toward unobstructed channels, thereby ensuring drainage of liquids away from a window assembly installed on the flashing assembly 1400. As shown in FIG. 14, the channels 1410 and the cross channel 1416 have a sloped configuration that routes liquid (e.g., water) toward the front flange 1408, optionally.

As shown in FIG. 14, the top portion includes a mounting surface 1418. In one option, the mounting surface 1418 includes a rear portion 1420 and a front portion 1422. The front portion 1422 surrounds at least a portion of the channels 1410 and separates the channels 1410. The mounting surface 1418 provides a level surface to support a window assembly installed in the rough opening and over the flashing assembly 1400. The channels 1410 are sloped and extend underneath the mounting surface 1418 and thereby route liquids (e.g., water) away from the window assembly supported on the mounting surface 1418. In another option, the level mounting surface 1418 allows for the interposition of shims between the window assembly and the flashing assembly 1400 to facilitate orientation of the window assembly in the rough opening.

The flashing assembly 1400 further includes a coupling portion 1409 similar in at least some respects to coupling portions described above. The coupling portion 1409 is a recessed surface near the end 1414B and is sized and shaped to receive a corresponding coupling portion from another flashing assembly 1400 member (e.g., side member, interconnecting member and the like, as previously described in other examples).

Figure 15:
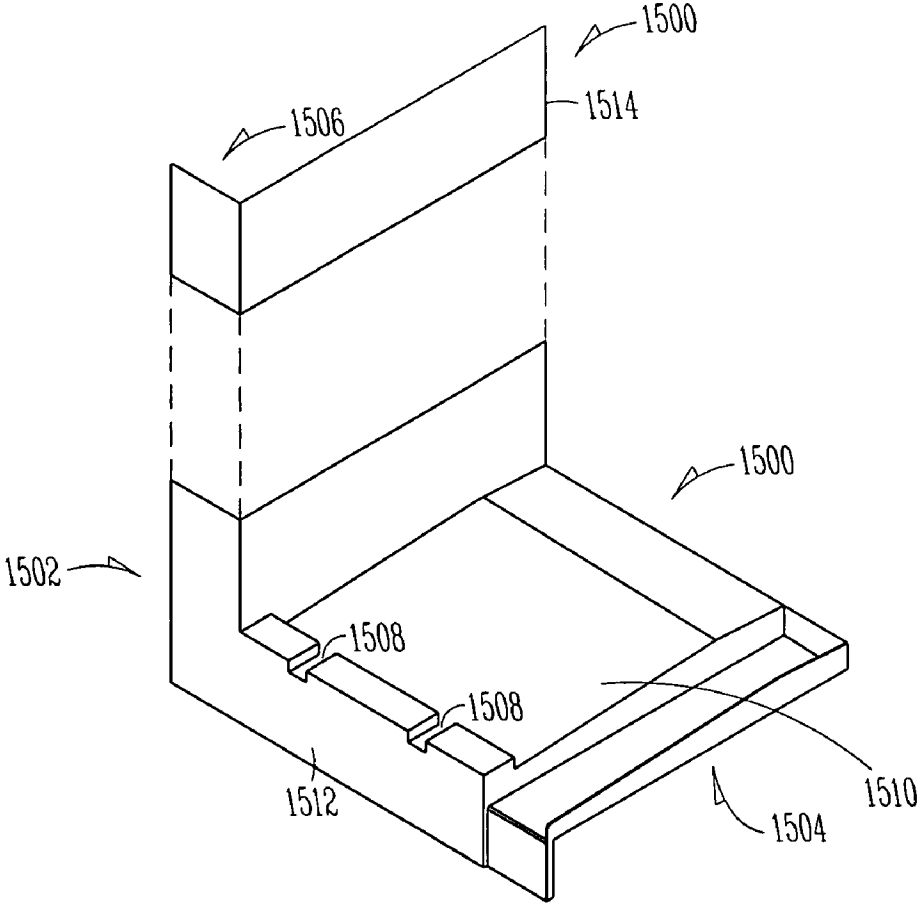
FIG. 15 illustrates an exploded perspective view of an example first side member of a flashing assembly constructed in accordance with at least still another example.

FIG. 15 shows another example of a flashing assembly 1500 having a modular construction. The side member 1502 shown in FIG. 15, includes a first portion 1504 and a second portion 1506 sized and shaped to couple with the first portion 1504. The first portion 1504 is similar in at least some respects to the side members described above in other examples. The first portion 1504 includes channels 1508 and at least one cross channel 1510 interconnecting the channels 1508, thereby ensuring liquids are routed toward a drainage plane along a front flange 1512. The second portion 1506 includes a side flange 1514 sized and shaped to couple with the first portion 1504. The second portion 1506 has a variety of sizes, in one option, thereby permitting a variety of combinations with the first portion 1504 to achieve a desired configuration for the flashing assembly 1500. In another option, at least one of the second portion 1506 and the first portion 1504 has a variety of sizes and configurations (e.g., channels, mounting surfaces, coupling portions and the like, as described above) facilitating assembly of a desired combination of a first portion 1504 with a second portion 1506.

Figure 17:
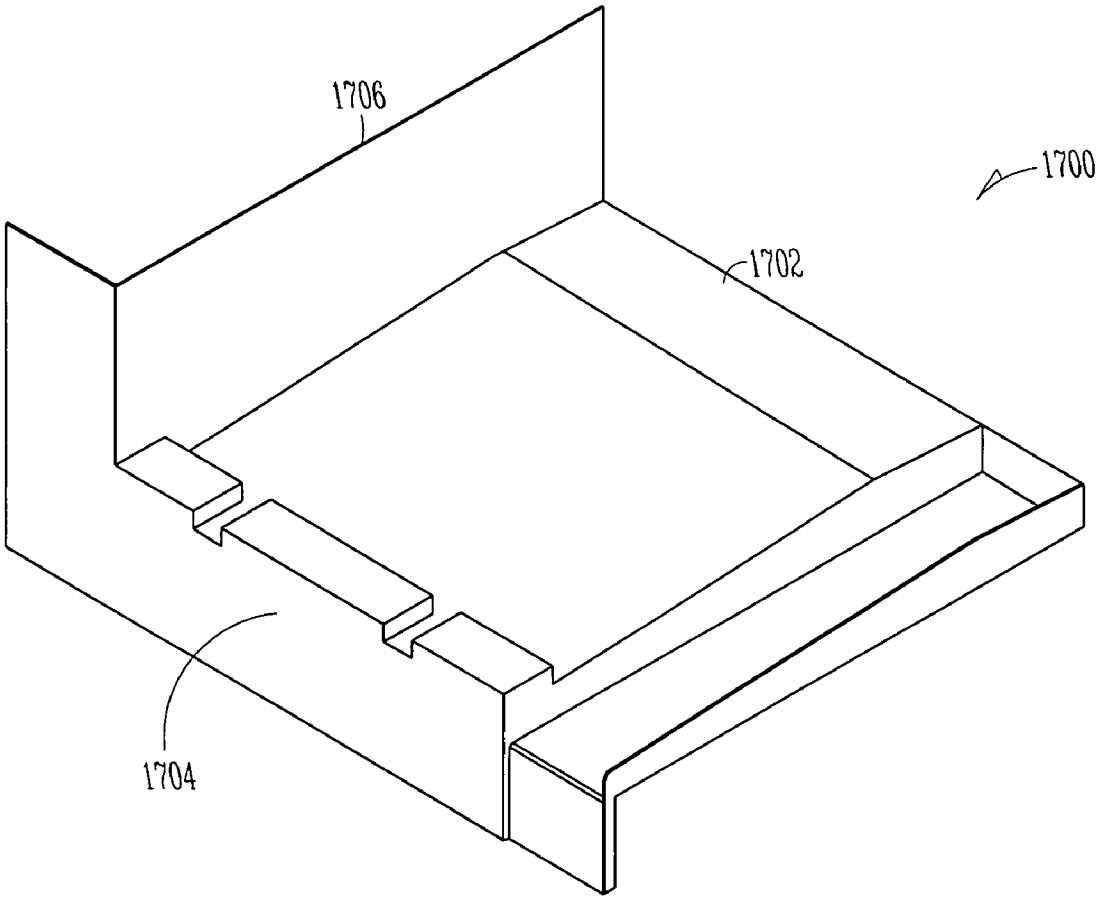
FIG. 17 illustrates a perspective view of an example first side member of a flashing assembly constructed in accordance with at least a further example.

FIG. 17, shows another example of a flashing assembly 1700 including flexible features, as described above. In one option, the flashing assembly 1700 includes a top portion 1702, front flange 1704 and a side flange 1706. Optionally, at least one of the front flange 1704 and the side flange 1706 include a pliable material such as rubber. Including a pliable material in at least one of the front flange 1704 and the side flange 1706 allows for flexing of the corresponding portions of the flashing assembly 1700 during and after installation. The flashing assembly 1700 thereby flexes as needed for installation and as a building gradually shifts over time. Additionally, the flexible portions of the flashing assembly 1700 facilitate flexing of the flashing assembly for convenience during shipping and packaging.

Figure 18:
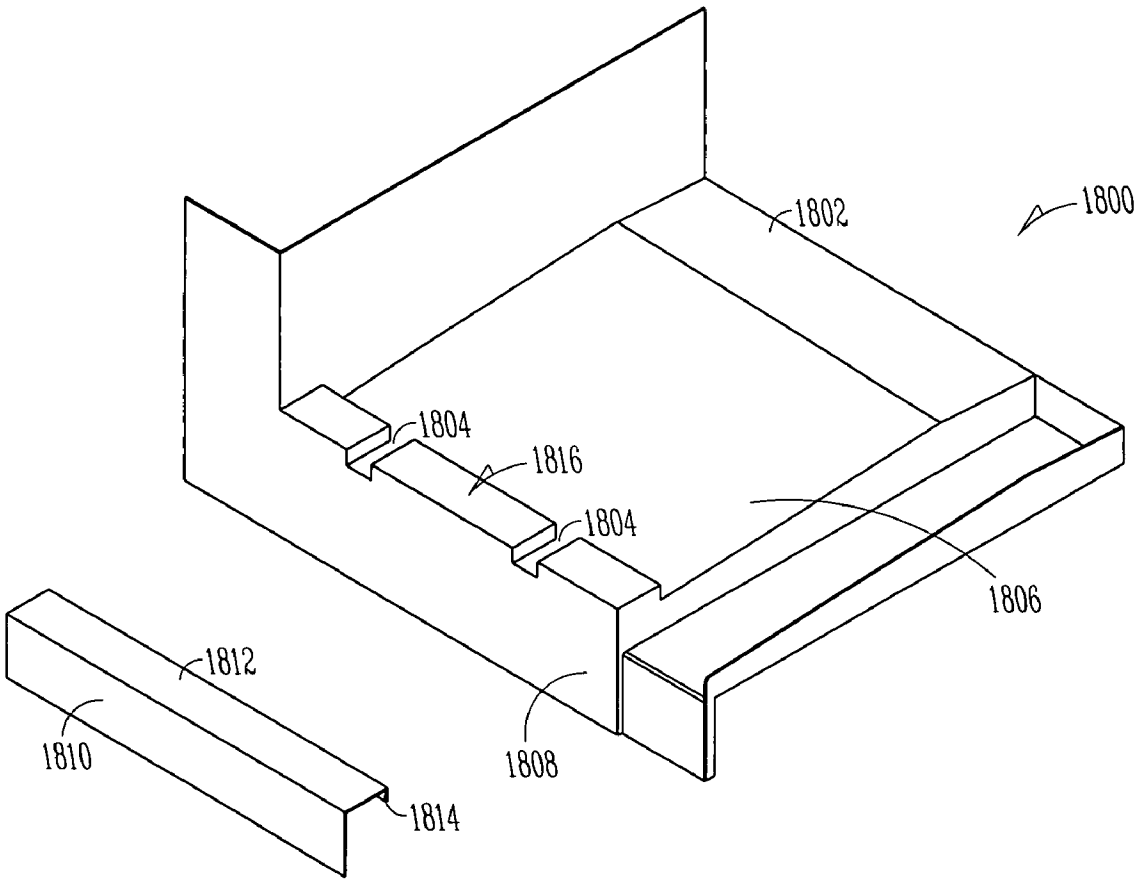
FIG. 18 illustrates an exploded perspective view of a first side member of a flashing assembly constructed in accordance with at least yet another example.
Figure 19:
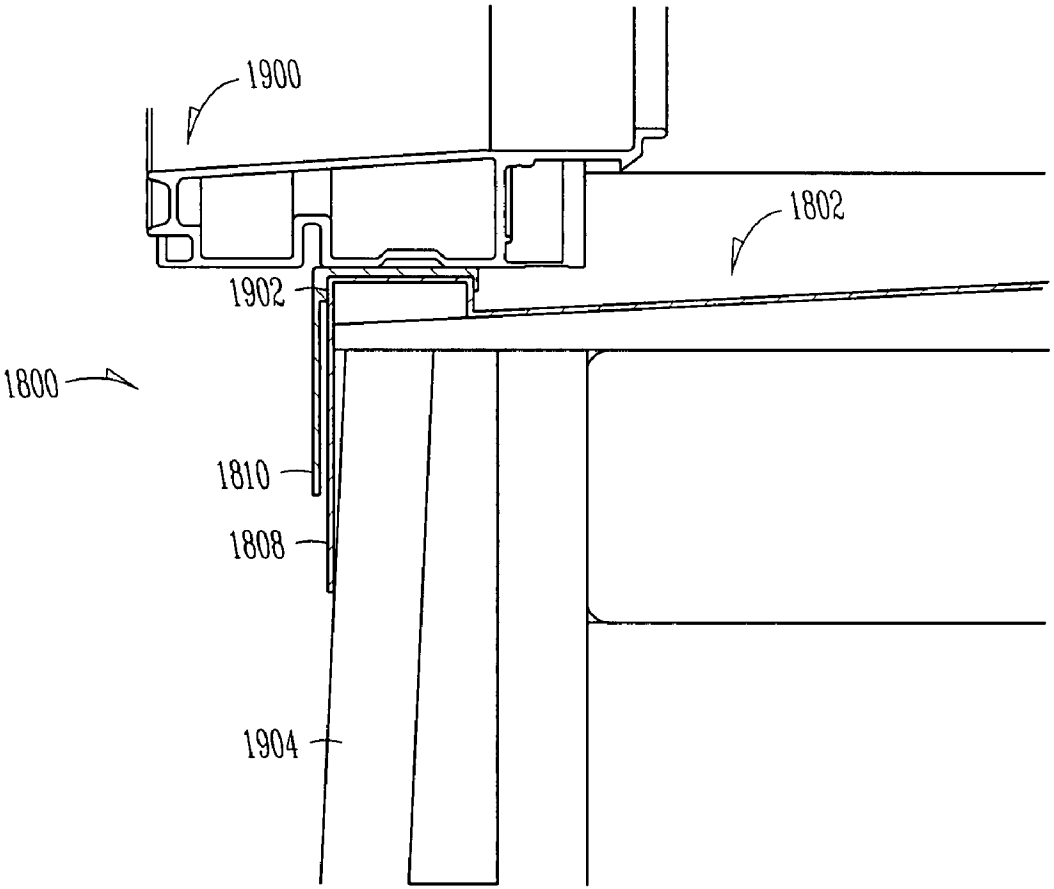
FIG. 19 illustrates a side cross sectional view of a flashing assembly in a window assembly constructed in accordance with at least yet another example.
Figure 20:
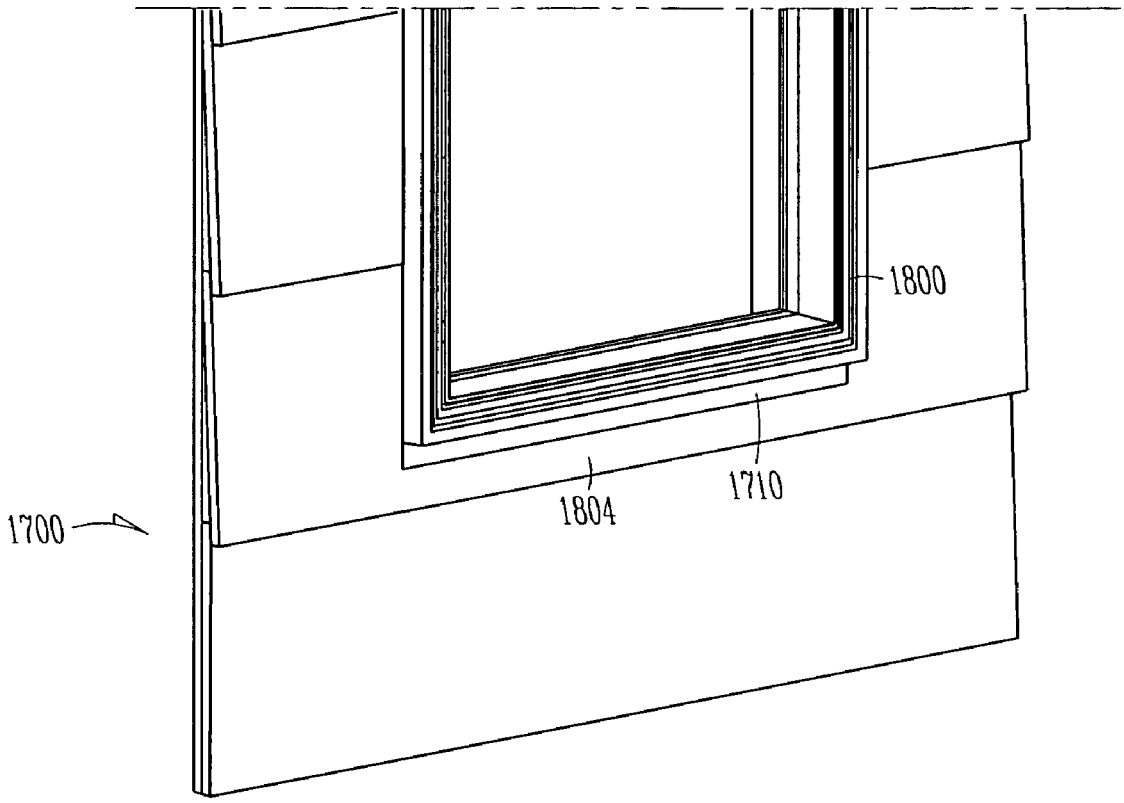
FIG. 20 illustrates an installed flashing assembly with a window assembly installed in accordance with at least yet another example.

Referring now to FIGS. 18, 19 and 20, another example of a flashing assembly 1800 is shown for use with a replacement window assembly 1900 (FIGS. 19, 20). The flashing assembly 1800 includes at least one member. As shown in FIG. 18, the flashing assembly 1800 includes a side member 1802. As described above in other examples, the flashing assembly 1800 includes interconnecting members and a second side member. The side member 1802, shown in FIG. 18 includes channels 1804 and a cross channel 1806 interconnecting the channels 1804. The cross channel 1806 ensures flow of liquids (e.g., water) toward a drainage plane, such as the front flange 1808 if one of the channels 1804 is blocked. The cross channel 1806 routes the liquid to an unobstructed channel 1804. The members of the flashing assembly 1800, including the side member 1802 are installed over pre-existing cladding 1904, such as siding, stucco and the like and the replacement window assembly 1900 is positioned on the flashing assembly 1800.

As shown in FIGS. 18, 19 and 20, the flashing assembly 1800 includes a trim piece 1810 sized and shaped to extend over at least a portion of the front flange 1808. In one option, the trim piece 1810 includes an upper portion 1812 having a lip 1814 that hooks the trim piece 1810 over a raised portion 1816 of the side member 1802. As shown in FIGS. 19 and 20, the trim piece 1810 conceals the front flange 1808 and provides a decorative pleasing appearance. Referring now to FIG. 19, the trim piece 1810 includes, in one option, a ridge 1902. The ridge 1902 engages against a portion of the raised portions 1816 and thereby spaces the trim piece 1810 away from the side member 1802. The ridge 1902 engages against only a portion of the raised portion 1816 and therefore does not close the channels 1804 (FIG. 18) and prevent the flow of liquid on to the front flange 1808. Because the ridge 1902 spaces the trim piece 1810 from the front flange 1808, liquids flow unobstructed from the channels 1804 and over the front flange 1808 away from the replacement window assembly 1900.

Figure 21:
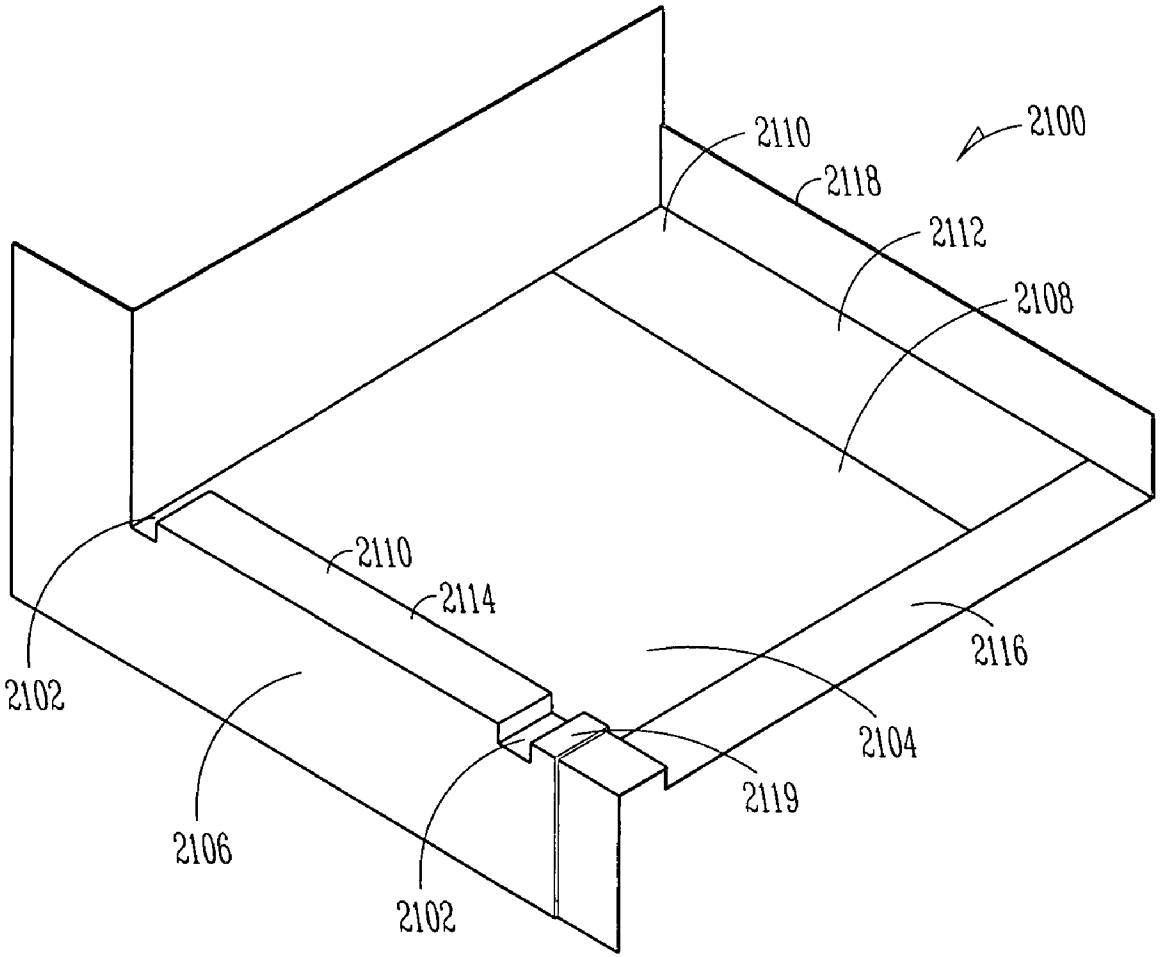
FIG. 21 illustrates a perspective view of a first side member constructed in accordance with at least one example.

FIG. 21 shows another example of a flashing assembly 2100 similar in at least some respects to the flashing assemblies described above. The flashing assembly 2100 includes channels 2102 and at least one cross channel 2104 interconnecting the channels 2102 to route liquid away from blocked channels to unobstructed channels, as described above. The cross channel 2104 and the channels 2102 are sloped and thereby urge liquids, such as water, toward a drainage plane including a front flange 2106. The top portion 2108 of the flashing assembly 2100 has a relatively small height compared with the previously described examples. The relatively small profile of the flashing assembly 2100 permits use of the flashing assembly 2100 with doors and the like.

The flashing assembly 2100 includes a mounting portion 2110 having a rear portion 2112 and raised portions 2114 that provide a level surface for mounting a door thereon. In another option, the flashing assembly 2100 includes at least one coupling portion 2116 sized and shaped to couple with a corresponding coupling portion for a member, such as a second side member, interconnecting member and the like, as described above. As shown in FIG. 21, the coupling portion 2116 has a recess relative to the raised portion 2114, cross channel 2104 and the rear portion 2112 to receive the coupling portion of another member thereon, as described above. In yet another option, the flashing assembly 2100 includes an interior lip 2118 extending from the rear portion 2112. The interior lip 2118 substantially prevents backflow of liquids and movement of a door assembly over the flashing assembly 2100.

Figure 22:
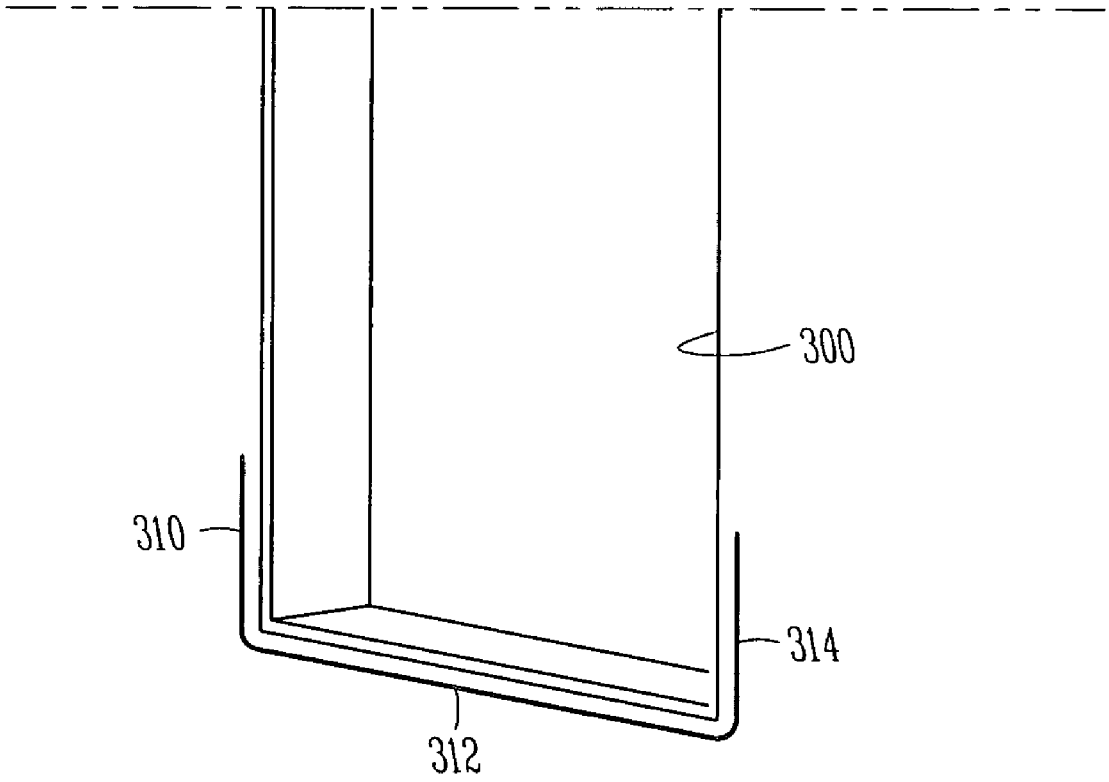
FIG. 22 illustrates a rough opening for use with the flashing assembly in accordance with at least one example.
Figure 23:
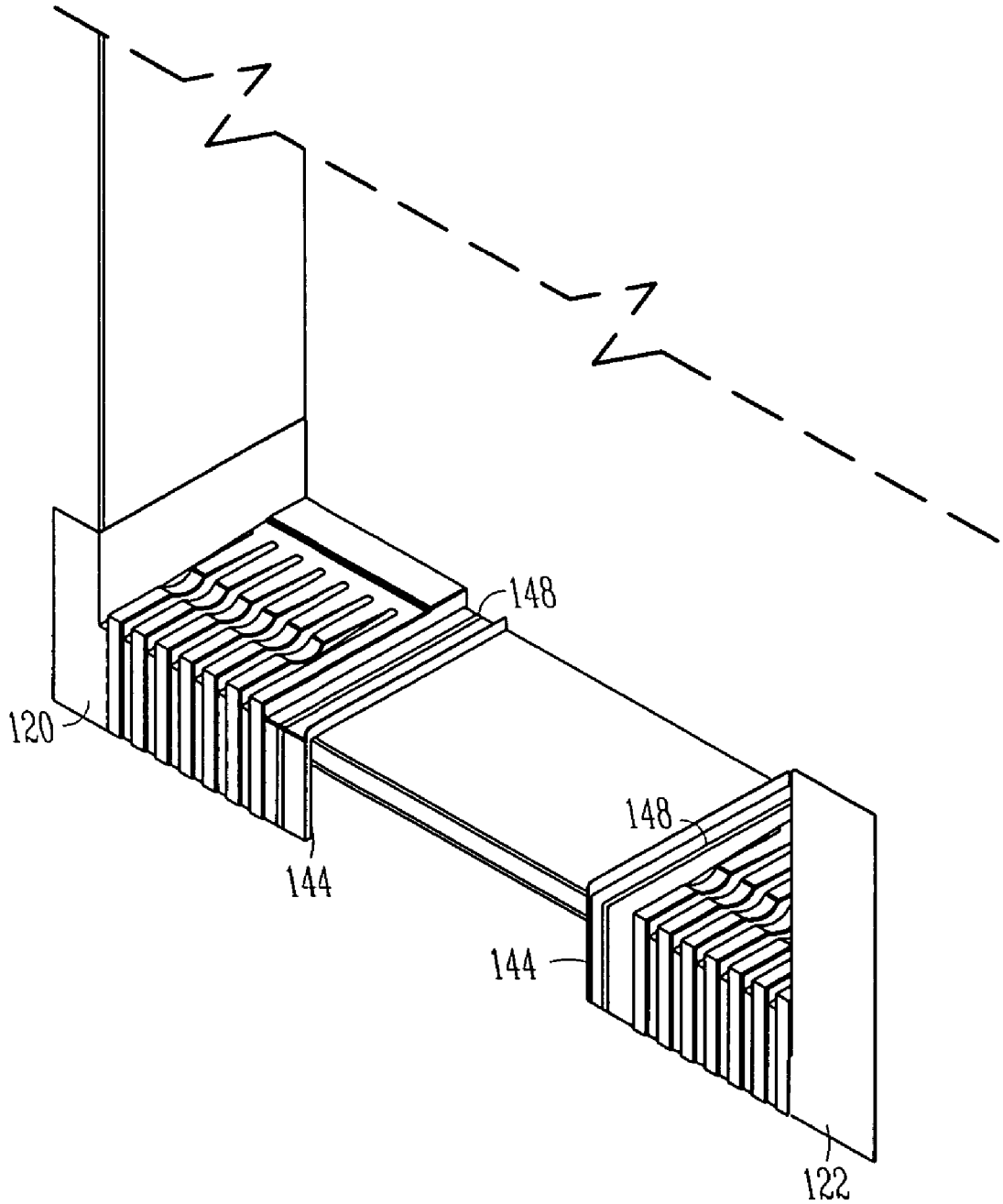
FIG. 23 illustrates at least a portion of the flashing assembly installed in a rough opening in accordance with at least one example.
Figure 24:
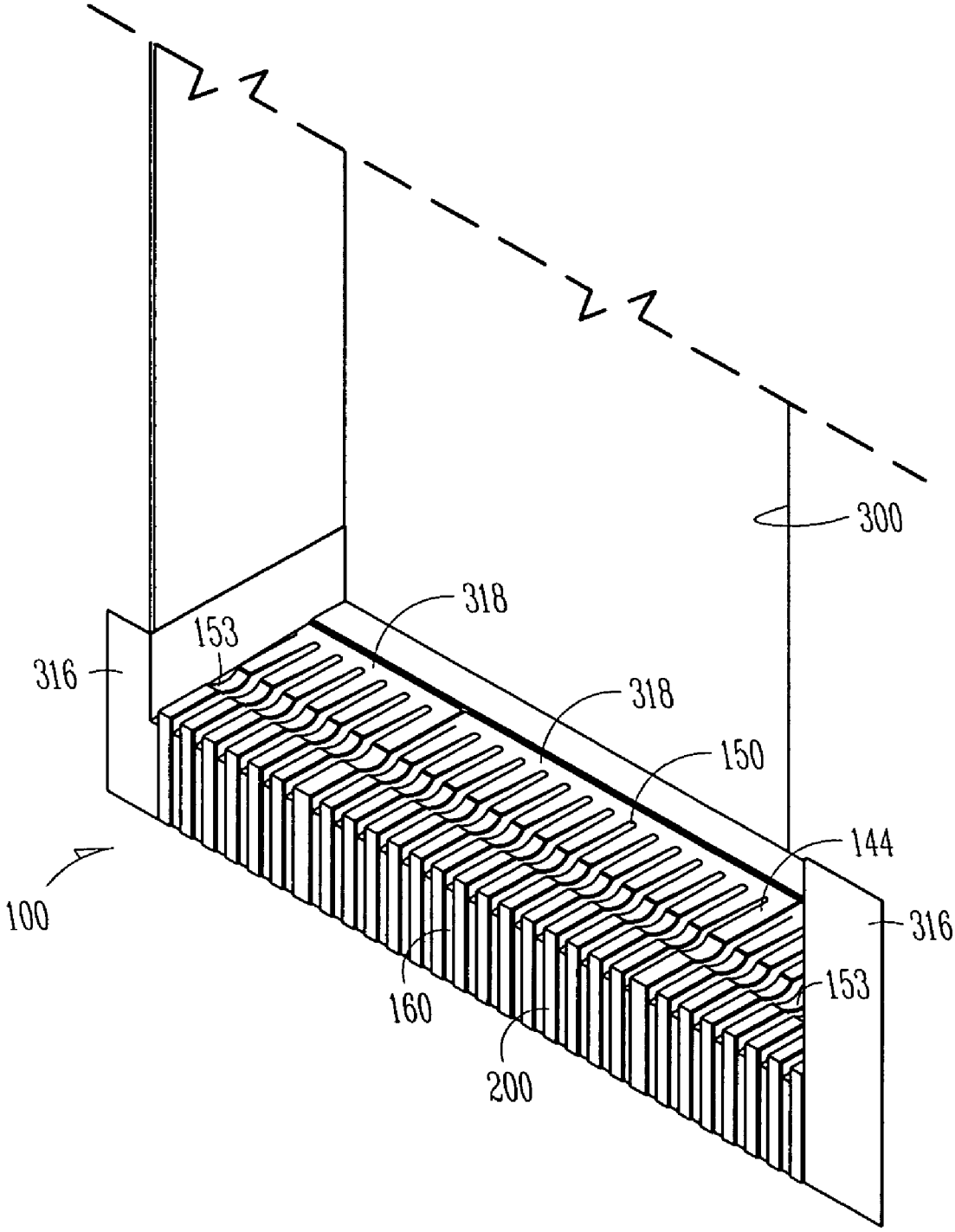
FIG. 24 illustrates at least a portion of the flashing assembly installed in a rough opening in accordance with at least one embodiment

A method for installing the flashing assembly is discussed herein and is provided in FIGS. 22-24. FIG. 22 illustrates a rough opening 300 in which the flashing assembly (e.g., as shown in FIGS. 1-21) and the window assembly will be installed. In installing the flashing assembly, such as flashing assembly 100, first an adhesive is applied to the outer portion of the rough opening. In one option, the vertical bead of sealant 310 is applied along with a lower sealant bead 312 and ending with a second vertical bead 314. Once the sealant is applied as shown in FIG. 21, the corner sections are installed, in one option, as shown in FIG. 23. The corner sections include, in one example, the first side member 120 and the second side member 122, described above. After or before the side members 120, 122 are installed a sealant, such as a coupling bead 148, is applied along the coupling portions 144 of the side members 120 and 122. Referring to FIG. 24, at least one interconnecting member 200 is placed on top of the coupling portions 144 over the sealant that is placed on the coupling portions to provide a sealed flashing assembly 100. Although in this example an adhesive sealant is described herein, it should be noted that other types of sealants may and can be used herewith.

As can be seen in the illustration of FIG. 24, the flashing assembly 100 forms a flashing assembly on the lower portion of the rough opening and extending up along the side portions of the rough opening as well. The window assembly can now be installed on top of the flashing assembly 100. In another option, prior to insulation of the window assembly, additional outer house wrap is placed over portion of the front flanges 316 to provide an additional sealing quality. The window assembly is placed over the flashing assembly 100 and the house wrap that is disposed over the front flange portions 316 is disposed between the window and a portion of the flashing assembly 100. As water enters the window assembly the water drains down into the flashing assembly 100 and the sloped channels 150 allow for the water to drain underneath the mounting surface and down onto the front flange 160. The front flange 160 assists in allowing water to drain away with the recesses 162. The cross channels 153 allow for alternative routes for the water to drain in the event that one of the channels 150 becomes obstructed with debris. Alternatively, the alternate paths with the cross channels 153 assist with water drainage in the event the water flow is too great for one of the channels 150. In another option, the cross channels 153 shown, for example, in FIGS. 4A, E, 8, route water away from the coupling portions 144 because the cross channels 153 are separated from the coupling portions 144. The cross channels 153 thereby assist in preventing leaks at the coupling portions 144. In yet another option the method includes removing at least a portion of at least one of the members 120, 122, 200, for instance by trimming, to fit the flashing assembly 100 within the rough opening 300. Because the cross channels 153 are separated from the ends of the members, trimming does not facilitate communication of the cross channels 153 with the newly formed coupling portion, as described above.

Furthermore, the mounting surface 318 provides a substantially level surface to support the window assembly installed over the flashing assembly 100. The level mounting surface allows for the interposition of shims and the like between the flashing assembly 100 and the window assembly. In one option, the absence of a back dam allows for insertion of the shims between the flashing assembly and the window assembly. Portions of the non-planar profiles of the channels 150, as described above, are parallel with the mounting surface 318 and thereby ensure the mounting surface 318 is level when the flashing assembly 100 is installed in the rough opening 300 (e.g., the profiles are engaged with the framework of the rough opening). Further still, the spaces between the profiles ensure airflow is maintained between the flashing assembly 100 and the rough opening to evaporate condensated moistures on the framework of the rough opening.

The flashing assembly described, with its many variations, allows for tremendous flexibility with respect to window size. It further allows for an easy installation process, while providing a superior flashing system that drains water effectively away from the window assembly. The flashing assembly further does not have a negative impact on jam depth or width, and further allows for effective assembly of the window assembly, for example, in the event the window assembly needs to be shimmed from a rear portion. The substantially planar top portion allows for fitting of shims between the window assembly and the flashing assembly. Optionally, the non-planar geometry of the profile of the top portion lower surface of the flashing assembly allows for airflow underneath the members and thereby assists in evaporating any fluid or moisture that accumulates (e.g., by condensation) between the flashing assembly and the framework (e.g., the framework of a rough opening in a wall). In another option, the cross channels ensure that liquids, such as water, are routed toward unobstructed channels and away from the window assembly. Further, the cross channels route liquids away from seams between the flashing assembly members, such as at coupling portions.

It is to be understood that the above description is intended to be illustrative, and not restrictive. Many other embodiments will be apparent to those of skill in the art upon reading and understanding the above description. It should be noted that embodiments discussed in different portions of the description or referred to in different drawings can be combined to form additional embodiments of the present application. The scope of the invention should, therefore, be determined with reference to the appended claims, along with the full scope of equivalents to which such claims are entitled.

What is claimed is:

1. A system comprising:

a flashing member including:

a first end and a second end, and the flashing member extends therebetween;

a top portion;

a flange at an angle to the top portion, and the flange extends from the top portion to a flange lower edge, and the top portion extends from a top portion rear edge to the flange, the top portion including a mounting surface, and the mounting surface is substantially level from the top portion rear edge toward the flange;

wherein the top portion includes two or more channels, the two or more channels extending along the top portion toward the flange, and sloped portions of the two or more channels extend along the top portion to the flange, the two or more channels and the sloped portions are configured to divert fluid to the flange through the two or more channels; and wherein the top portion includes at least one cross channel adjacent to the flange, the at least one cross channel is in communication with the two or more channels, and the cross channel is separated from at least one of the first end and the second end.

2. The system of claim 1, wherein the two or more channels include a corresponding profile extending along a lower surface of the top portion, and the mounting surface and a portion of the corresponding profile are substantially parallel.

3. The system of claim 1, wherein the mounting surface includes raised portions extending along and between the two or more channels.

4. The system of claim 3, wherein at least one raised portion separates the cross channel from at least one of the first end and the second end.

5. The system of claim 1, wherein a first channel of the plurality of channels has a greater width than the width of a second channel.

6. The system of claim 5, wherein the second channel of the plurality of channels is adjacent one of the first end and the second end.

7. The system of claim 1, wherein the two or more channels include a second portion extending along the flange from the top portion to the flange lower edge.

8. The system of claim 1, further comprising a trim piece sized and shaped to extend over a portion of the front flange, and the trim piece is spaced from at least the front flange.

9. The system of claim 1, wherein at least one of the first end and the second end includes a coupling portion, and the cross channel is separated from the coupling portion and extends away therefrom.

10. The system of claim 9, further comprising a second flashing member, and the coupling portion is sized and shaped to couple with the second flashing member.

11. A system comprising:

a first flashing member having a first end;

a second flashing member having a second end, and the second end is sized and shaped to couple with the first end;

wherein the first flashing member and the second flashing member include a plurality of channels extending along a top portion to at least a front flange, the front flange extending away from the top portion at an angle, the plurality of channels include a profile extending along a lower surface of the top portion, and a portion of the profile and a first portion of the top portion are substantially parallel; and wherein at least one of the first flashing member and the second flashing member includes a cross channel in communication with two or more channels of the plurality of channels, the cross channel is adjacent to the front flange, and the cross channel is isolated from the first and second ends of the first and second flashing members, and the cross channel is isolated from one or more channels of the plurality of channels adjacent to one or both of the first or second ends of the first and second flashing members.

12. The system of claim 11, wherein the first flashing member is a side member including a side flange contiguous with the top portion, and the front flange extends from the side flange at an angle.

13. The system of claim 11, wherein the second flashing member is an interconnecting member, and the interconnecting member includes a third end opposite the second end.

14. The system of claim 11, wherein the plurality of channels includes a first channel, and the first channel is separated from the at least one cross channel and adapted for trimming.

15. The system of claim 11, wherein the first flashing member and the second flashing member include the top portion and the front flange, and the top portion includes a mounting surface, and the mounting surface is substantially level from the top portion rear edge toward the front flange.

16. The system of claim 15, wherein the mounting surface includes raised portions extending along and between the two or more channels.

17. The system of claim 15, wherein the mounting surface is sized and shaped to receive a window assembly thereon.

18. The system of claim 11, wherein the first end includes a first coupling portion and the second end includes a second coupling portion, and the cross channel is separated from at least one of the first coupling portion and the second coupling portion and extends away therefrom.

19. A system comprising:

a flashing member extending from a first end to a second end, the flashing member includes:

a top portion;

a flange at an angle to the top portion, and the flange extends from the top portion to a flange lower edge, and the top portion extends from a top portion rear edge to the flange, the top portion includes a mounting surface and a lower surface profile opposed to the mounting surface, and the mounting surface is substantially level from the top portion rear edge toward the flange with respect to the lower surface profile;

a plurality of channels extending over the top portion, and sloped portions of the plurality of channels extend along the top portion to the flange;

raised portions between two or more of the channels, the mounting surface includes the raised portions, and the raised portions extend over the top portion from near the top portion rear edge toward the flange;

wherein the top portion includes at least one cross channel in communication with two or more of the plurality of channels, the cross channel extends through one or more of the raised portions between the plurality of channels, and the cross channel is separated from at least one of the first end and the second end by at least one raised portion; and wherein one or more of the plurality of channels near at least one of the first end and the second end of the flashing member are separated from the cross channel and the remainder of the plurality of channels.

20. The system of claim 19, wherein the cross channel is adjacent to the flange.

21. The system of claim 19, wherein the cross channel is remote from the flange and positioned between the flange and the top portion rear edge.

22. The system of claim 19, wherein at least one of the first end and the second end includes a coupling portion, and the cross channel is separated from the coupling portion by at least one raised portion.

23. The system of claim 19, wherein the lower surface profile includes a contoured surface extending beneath one or more of the of the plurality of channels or the raised portions.

24. The system of claim 19, wherein a first channel of the plurality of channels has a greater width than the width of a second channel.

25. The system of claim 24, wherein the second channel of the plurality of channels is adjacent one of the first end and the second end.

26. The system of claim 19, wherein one or more of the plurality of channels includes a second channel portion extending along the flange from the top portion to the flange lower edge.

27. The system of claim 26, wherein the second channel portion is recessed relative to an exterior facing surface of the flange.

28. The system of claim 19 further comprising a trim piece sized and shaped to extend over a portion of the front flange, and the trim piece is spaced from at least the front flange.

29. The system of claim 19 further comprising a second flashing member, and the coupling portion is sized and shaped to couple with the second flashing member.

* * * * *

UNITED STATES PATENT AND TRADEMARK OFFICE

CERTIFICATE OF CORRECTION

PATENT NO. : 7,877,945 B2
APPLICATION NO. : 11/342307
DATED : February 1, 2011
INVENTOR(S) : Mark D. Eggen et al.

It is certified that error appears in the above-identified patent and that said Letters Patent is hereby corrected as shown below:

In column 18, line 7, in Claim 23, after "of the" delete "of the".

Signed and Sealed this
Twelfth Day of April, 2011

David J. Kappos

David J. Kappos
*Director of the United States Patent and Trademark Office*